US005603253A

United States Patent [19]

Logan

[11] Patent Number: 5,603,253

[45] Date of Patent: Feb. 18, 1997

[54] METHOD FOR CUTTING A GROOVE IN A MATBOARD

[76] Inventor: Malcolm Logan, 555 Signal Hill Rd., Barrington, Ill. 60010

[21] Appl. No.: 192,232

[22] Filed: Feb. 4, 1994

[51] Int. Cl.[6] ..... B26D 3/06; B26D 1/11

[52] U.S. Cl. ..... 83/875; 83/468.7; 83/563; 83/578; 83/581; 83/588; 83/614; 83/620

[58] Field of Search ..... 83/56, 578, 581, 83/614, 875, 877, 35, 36, 39, 563, 564, 582, 588, 455, 640, 468, 468.7, 620; 30/287

[56] References Cited

U.S. PATENT DOCUMENTS

| | | | |
|---|---|---|---|
| 2,274,978 | 3/1942 | Currier | 83/578 |
| 2,835,037 | 5/1958 | Middents | 83/614 X |
| 3,108,349 | 10/1963 | Takacs | 83/578 X |
| 3,130,622 | 4/1964 | Eno | 83/564 X |
| 3,292,477 | 12/1966 | Raftery | 83/582 X |
| 3,301,117 | 1/1967 | Spaulding | 83/614 X |
| 3,463,041 | 8/1969 | Shapiro et al. | 83/564 |
| 3,527,131 | 9/1970 | Ellerin et al. | 83/564 X |
| 3,779,119 | 12/1973 | Broides | 83/564 X |
| 4,158,977 | 6/1979 | Logan | 83/614 X |
| 4,249,437 | 2/1981 | Hagenson | 83/39 |
| 4,440,055 | 4/1984 | Gelfand | 83/564 X |
| 4,505,174 | 3/1985 | Carithers, Jr. | 83/455 |
| 4,641,556 | 2/1987 | Vigneron et al. | 83/36 |
| 4,662,258 | 5/1987 | Mood | 83/455 |
| 4,685,366 | 8/1987 | Beder | 83/455 |
| 4,798,118 | 1/1989 | Carithers, Jr. | 83/875 |
| 4,858,507 | 8/1989 | Evans et al. | 83/614 X |
| 4,881,439 | 11/1989 | Biedermann et al. | 83/582 X |
| 5,099,727 | 3/1992 | Kozyrski et al. | 83/464 X |
| 5,309,642 | 5/1994 | McGinnis | 83/614 X |
| 5,388,488 | 2/1995 | Geidl et al. | 83/455 X |

OTHER PUBLICATIONS

"The Supreme Model 600 by Logan Instruction and Operation Manual," Logan Graphic Products, Inc. Form 1101. (Date unknown).

"Time Is Money" Advertising Brochure (two-sided sheet) for the Freegrover with accompanying photographs, A, B, and C. (Date unknown).

"Classic Detachable V-Groover" by C.I.A. Co., Inc. (Instruction Manual) and photographs #1, #2, #3, and #4 of an actual product. 1987.

Freegroover/Logan 3-Step Adapter Block Instructions (One Sheet). (Date unknown).

Advertising sheet entitled "Carve V-Grooves Fast with the Cleargroover." (Date unknown).

"Owner's Manual —Fletcher 1100 Professional Oval and Circle Cutting System." (Date unknown).

*Primary Examiner*—Rinaldi I. Rada
*Assistant Examiner*—Clark F. Dexter
*Attorney, Agent, or Firm*—Dressler, Goldsmith, Milnamow & Katz, Ltd.

[57] ABSTRACT

A method and apparatus are provided for cutting a decorative groove in a matboard. The matboard is positioned adjacent a guide. A carrier is adapted to be moved along the guide with two blades oriented in separate planes which intersect each other and which lie at an oblique angle relative to the matboard. One of the blades is inserted into the matboard at a selected first depth. The carrier is moved along the guide for a predetermined length of travel to make a first cut in the matboard defining a first side of the groove. The blade is then retracted. Then the other blade is next inserted into the matboard to a selected depth at least intersecting the first cut. The carrier is then moved back to the initial location to make a second cut in the matboard defining a second side of the groove. In a preferred embodiment, the tips of the blades are offset from each other relative to the length of the groove.

9 Claims, 11 Drawing Sheets

METHOD FOR CUTTING A GROOVE IN A MATBOARD

TECHNICAL FIELD

The present invention relates to providing a matboard with a groove in one surface and is particularly suitable for providing V-grooves in a rectangular configuration within which an opening can be cut out for displaying artwork or the like.

BACKGROUND OF THE INVENTION AND TECHNICAL PROBLEMS POSED BY THE PRIOR ART

Matboard, which typically has a paperboard or cardboard composition, is provided in a variety of decorative surface colors. The decorative color is limited to substantially the display surface of the matboard. The color of the matboard below the display surface is typically a light color different than the surface color, such as a shade of white or beige.

A groove provided in such matboard around the matboard opening will thus reveal the underlying matboard color in contrast with the matboard display surface color. This can provide a decorative and pleasing effect.

Because the central opening is typically cut in the matboard with a matboard cutting machine or cutter, accessory devices have been developed for use with such matboard cutting machines for cutting a V-groove in the matboard. Such accessory devices use the matboard cutting machine to guide the V-groove cutting device so as to provide a V-groove outwardly of the matboard region which contains, or which will subsequently contain, the central opening for the artwork or other piece to be displayed.

Conventional devices or methods for cutting decorative grooves in matboard are not completely satisfactory, especially with respect to cutting V-grooves in a polygon configuration, such as a rectangle. Some systems are relatively complicated and require a number of steps which are relatively time consuming.

For example, in one system employing a conventional mat-cutting machine, a drop-out piece, which is larger than the final opening that will subsequently be cut, is cut out of the matboard with a single blade producing a bevel cut while the matboard is face down on the cutting machine. Next, the drop-out piece is placed face up on the cutting machine, and each edge is trimmed with a bevel cut opposite to the direction of the original bevel cut. The trimmed, drop-out piece is then placed back into the opening and taped in place. This results in a V-groove. Finally, the desired opening for the artwork is cut in the taped-together matboard in a conventional manner inside of the rectangular V-groove.

Other V-groove cutting systems employ cutting heads which contain two, converging blades arranged in a generally V-shaped configuration. The pointed, distal ends of the blades are arranged to just touch each other. With one such head, the blades are held stationary while the head is moved to cause the blades to cut into the matboard. As the blades are moved along the matboard, the frictional forces exerted on the blade tips tend to spread the tips apart slightly. Thus, the bottom of the groove may not completely cut. The apex or bottom of the V-groove tends to have a ragged appearance after the cut strip is pulled away from the groove.

Another type of V-groove cutting head with two blades employs a system which pivots both blades downwardly into the matboard to establish the insertion depth of the blade tips. Because the blades pivot into the matboard, there is an initial portion of each cut forming a side of the V-groove which starts at the surface of the matboard and curves forwardly and downwardly to the final depth. As a result, at each corner of the rectangular configuration of the V-grooves, there are cuts in the surface of the matboard which extend slightly beyond the rectangle. These cuts are aesthetically objectionable. Further, after the blades have been pivoted to the selected, full depth, the butting tips will tend to be spread apart as the cutting head is moved along the matboard. This can result in the bottom of the V-groove having a ragged appearance.

In view of the above-discussed deficiencies exhibited by prior art systems, it would be desirable to provide an improved method and apparatus for cutting a V-groove in a matboard. In particular, it would be advantageous if an improved system for creating a V-groove could be employed to provide V-grooves in a rectangular configuration, or other polygon configuration, wherein each corner of the rectangle or other polygon is free of cuts extending in the matboard surface beyond the grooves.

Further, it would be desirable if such an improved system resulted in the production of a groove wherein the bottom or apex of the V-groove is generally well-formed, straight, and smooth.

Also, it would be advantageous if such an improved groove-forming system could be effective to cut both sides of the groove so that the cuts intersect to completely sever the material within the groove from the remaining portion of the matboard so as to permit easy removal of the cut material in a way that does not require pulling or tearing of matboard material at the bottom of the groove.

It would also be desirable to provide an improved system which could be operated with a conventional straight edge as well as with conventional matboard cutting machines.

Additionally, it would be advantageous if such an improved system could be readily adjusted as desired for different groove widths, groove lengths, and matboard thicknesses.

The present invention provides an improved groove cutting system which can accommodate designs having the above-discussed benefits and features.

SUMMARY OF THE INVENTION

The present invention provides a novel system for efficiently and effectively creating decorative grooves in a matboard. With the system, grooves can be provided in a rectangular, or other polygon, configuration. The surface of the matboard is free of cuts extending beyond the grooves at the corners of the rectangle or other polygon.

A groove provided with the system of the present invention has a generally smooth bottom region which is cleanly cut and which is free of tears which could provide a ragged appearance characteristic of grooves produced by some prior art devices.

One aspect of the invention includes a method for providing the matboard with two cuts from between which a portion of the matboard can be removed to expose a decorative, linear groove having an angular, transverse cross-section. According to the method, the matboard is positioned adjacent a linear guide. At a selected initial location on the linear guide, a carrier is positioned for guided movement along the guide while carrying two blades oriented in separate planes. The planes intersect each other and lie at an oblique angle relative to the matboard.

One of the blades is inserted into the matboard to a selected first depth. The carrier is then moved along the guide for a predetermined length of travel to make a first cut in the matboard defining a first side of the groove. The blade is then retracted.

Next, the other blade is inserted into the matboard to a selected second depth at least intersecting the first cut.

The carrier is then moved back to the selected initial location to make a second cut in the matboard defining a second side of the groove. Thereafter, the blade is retracted from the matboard.

In another form of the method, the matboard is also positioned adjacent a linear guide. At a selected initial location on the linear guide, a carrier is positioned for guided movement along the guide while carrying two blades which each lie in a separate plane. The planes are oriented at an oblique angle relative to the matboard and intersect along a line defining the bottom of the groove. Each blade has a tip defined by a leading cutting edge and a trailing edge so that the tips are offset relative to the length of the groove. Each blade can be inserted to a selected depth in the matboard, and the carrier can be moved along the guide to make cuts in the matboard defining first and second sides of the groove. In the preferred form of operation, one blade is inserted and moved along the matboard while the other blade is retracted. Then the first inserted blade is retracted, and the other blade is inserted and moved along the matboard.

In a preferred form of the apparatus, the carrier is adapted to be positioned on the matboard adjacent a linear guide for movement along the guide. The carrier includes two blades which each lie in a separate plane. The planes are each oriented at an oblique angle relative to the matboard and intersect each other along a line defining the bottom of the groove. The blades each have a tip defined by a leading cutting edge and a trailing edge oriented so that the tips are offset relative to the length of the groove. Each blade is insertable to selected depths in the matboard.

In another form of the apparatus, the carrier also includes two blades oriented in separated planes which intersect each other along a line and which each lie at an oblique angle relative to the matboard. However, the blades may or may not be offset relative to the length of the groove. The carrier includes operating members connected to the blades for separately and independently moving the blades between an inserted position in the matboard and a retracted position above the matboard. Preferably, the blades are inserted perpendicularly relative to the line defining the bottom of the groove.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the apparatus of this invention is described in the normal (upright) operating position, and terms such as upper, lower, horizontal, etc., are used with reference to this position. It will be understood, however, that the apparatus of this invention may be manufactured, stored, transported, used, and sold in an orientation other than the position described.

Figures illustrating the apparatus show some mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

The apparatus of this invention is used with certain conventional components the details of which, although not fully illustrated or described, will be apparent to those having skill in the art and an understanding of the necessary functions of such components.

Figure 1:
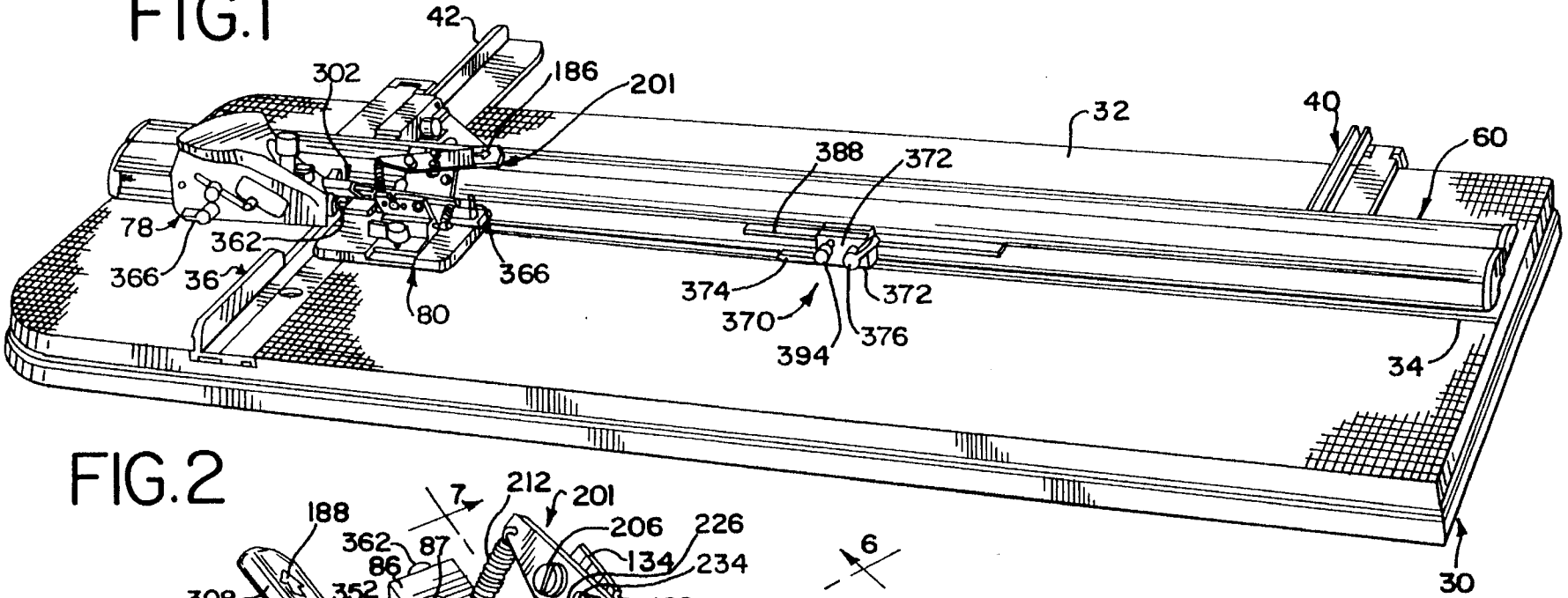
FIG. 1 is a perspective view of the apparatus of the present invention shown mounted on a matboard cutting machine.

One embodiment of the apparatus of the present invention is illustrated in FIG. 1 as being mounted on a matboard cutting machine 30. The machine 30 includes a base or platform 32 which defines a linear channel 34 to accommodate the projecting tip of a cutting blade of conventional matboard cutting heads.

A squaring arm 36 is mounted across one end of the platform 32, and an edge of a matboard can be positioned against the squaring arm 36 to ensure that the matboard edge is perpendicular to the channel 34.

A mat guide 38 (FIG. 3) is mounted to the platform 32. The mat guide 38 is adjustable so that its distance from the blade channel 34 can be set as desired. The mat guide 38 is parallel to the blade channel 34, and an edge of a matboard can be butted against the mat guide to properly position the matboard relative to the blade channel 34. The mat guide 38 is slidably disposed at one end on a channel member 40 and is slidably disposed on an upwardly projecting flange 42 at the other end.

Figure 3:
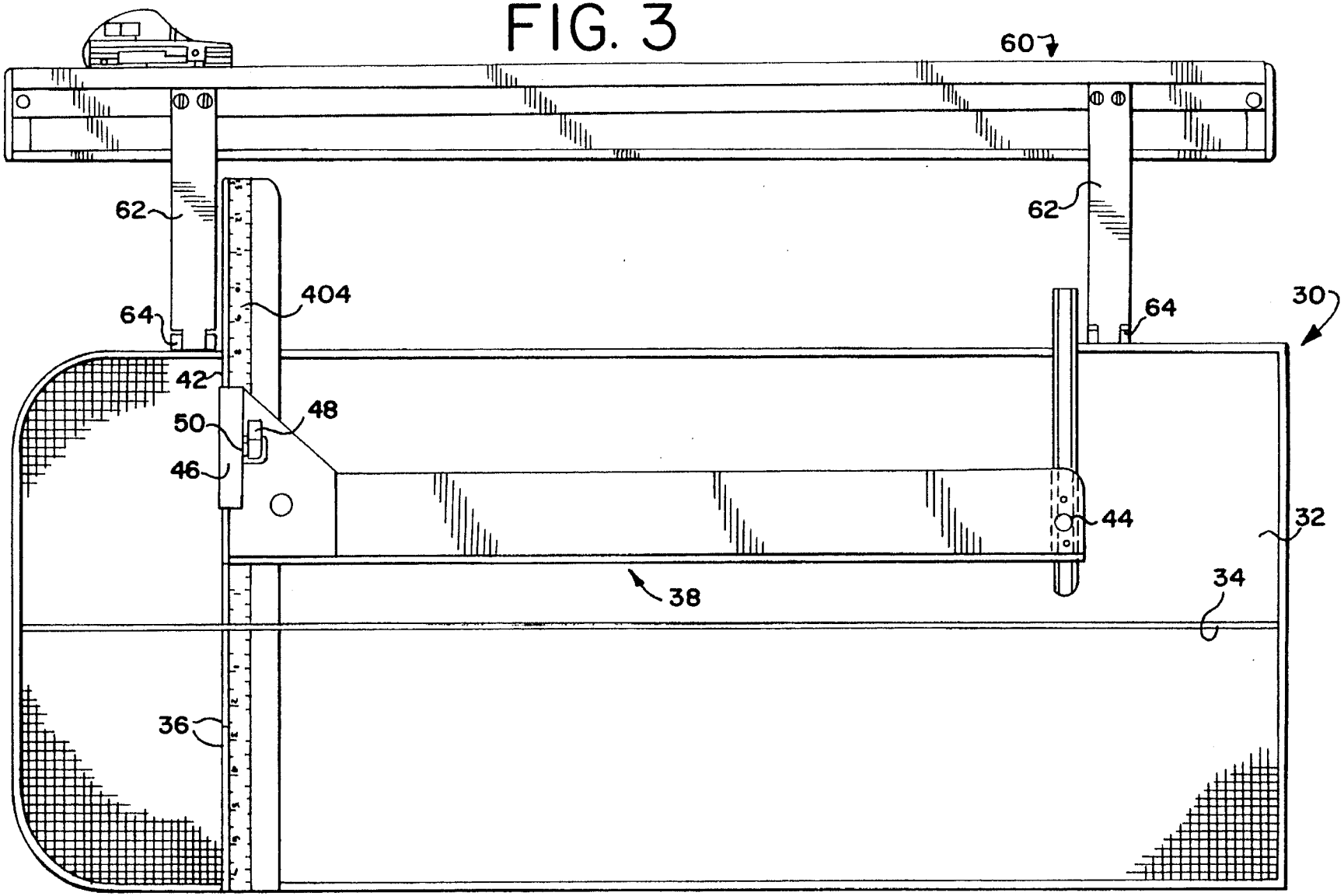
FIG. 3 is a plan view of the matboard cutting machine shown in FIG. 1 with the guide rail pivoted 180° from the operating position illustrated in FIG. 1 to an open, loading position, and the V-groove right-hand cutting head and V-groove end stop have been omitted from FIG. 3 for purposes of clarity.

The channel member 40 is recessed in the platform 32, and a suitable clamping assembly is disposed within the channel member 40 and threadingly engaged with an operating knob 44 (FIG. 3).

The other end of the mat guide has a channel block 46 defining a downwardly open channel in which is received the flange 42. An operating lever 48 has a shank 50 that is threadingly engaged in an aperture in the block 46 and which has a distal end for engaging the flange 42.

The squaring arm 36, mat guide 38, and mechanisms for releasably clamping each end of the mat guide 38 at selected locations on the platform 32 may be of any suitable conventional or special design. The details of such structures form no part of the present invention.

Figure 4:
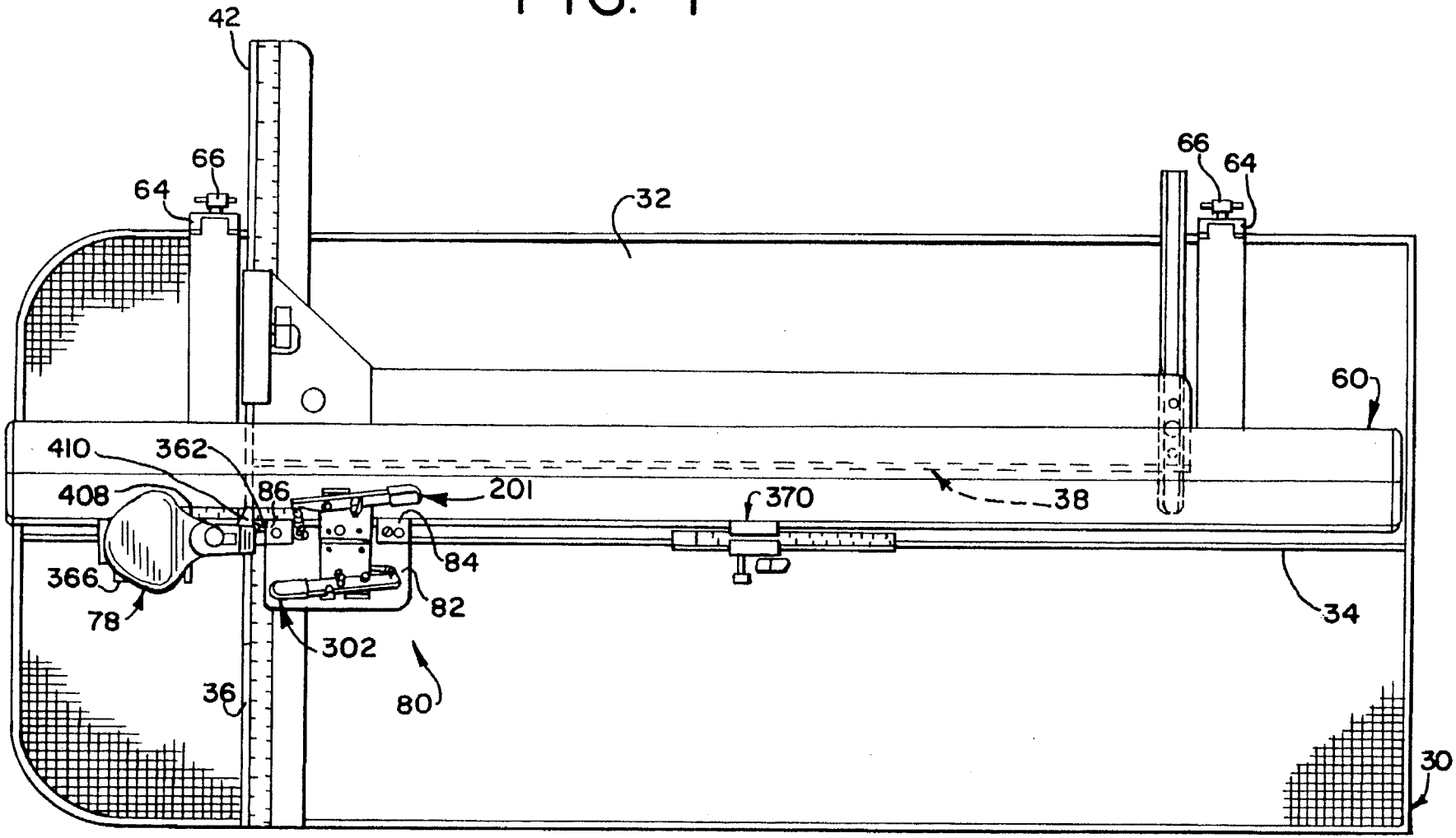
FIG. 4 is a plan view of the matboard cutting machine with the apparatus of the present invention arranged in an initial set-up position.
Figure 6:
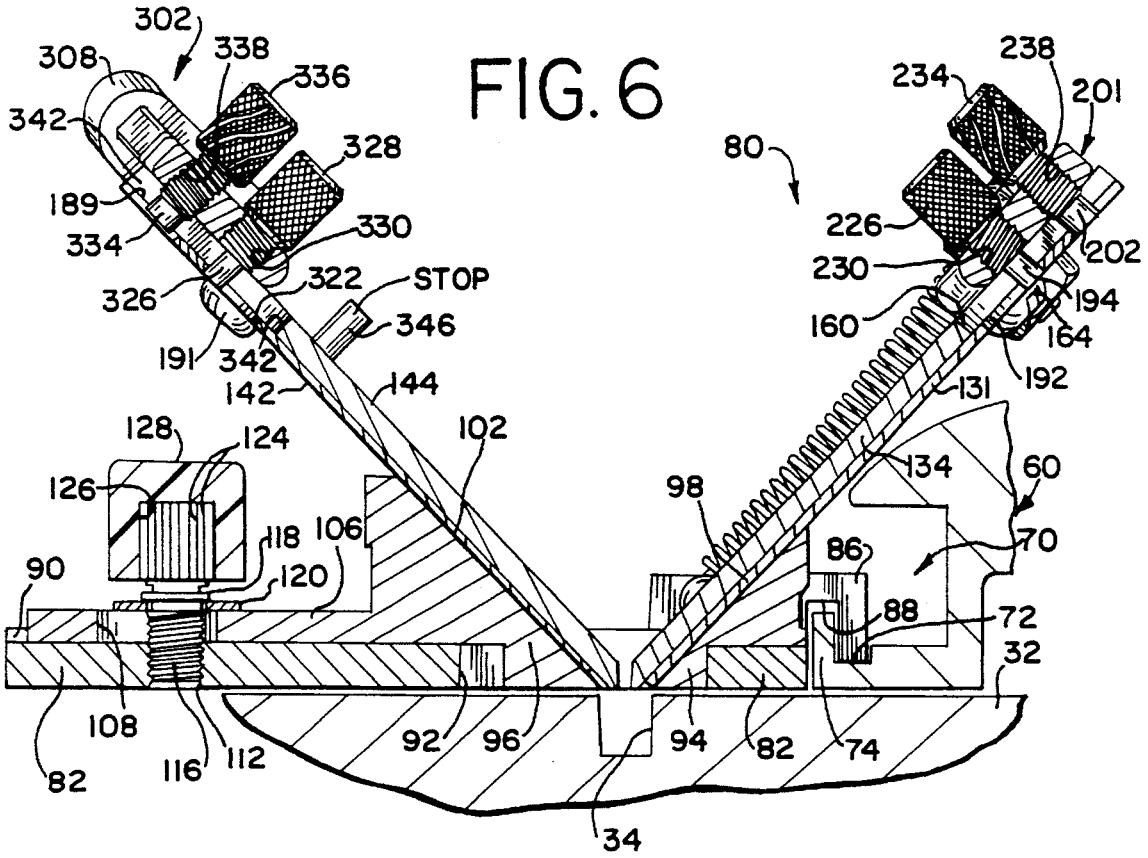
FIG. 6 is a greatly enlarged, fragmentary, cross-sectional view taken generally along the plane 6—6 in FIG. 2 with portions of the matboard cutting machine included for clarity to show the nature of the engagement between the V-groove cutting head and the matboard cutting machine.

The matboard cutting machine 30 also includes a movable guide rail 60. The guide rail 60 has a pair of arms 62 which are each pivotally mounted with a pin (not visible in the Figures) to a bracket 64 on the side of the platform 32. As illustrated in FIG. 4, each bracket 64 is removably clamped or otherwise secured to the side of the platform 32 with a threaded screw clamp 66. The guide rail 60 is movable between an operative position illustrated in FIG. 4 and an open, matboard-loading position illustrated in FIG. 3. As illustrated in FIG. 6, the inside edge of the guide rail 60 defines a recess 70 which includes a smaller channel 72 and an adjacent, upstanding lip or rail 74.

The guide rail 60 is adapted to receive a conventional or special cutting head having one or more blades with cutting tips movable into and out of the blade groove 34. A portion of a conventional cutting head 78 (FIGS. 1, 3, 4, and 5) is received in the guide rail recess 70 and channel 72 to engage the rail 74 for accommodating movement of the cutting head 78 along the guide rail 60. The matboard cutting machine 30, insofar as it has been described above, may be employed in a conventional manner to cut matboard. The cutting head 78, or other cutting head, may be provided with mechanisms for tilting the cutting blade relative to the surface of the platform 32 so as to provide a angled or beveled cut in the matboard in a well-known manner.

The guide rail 60 and cutting head 78 may be of any suitable conventional or special design. The specific designs of the cutting head 78 and guide rail 60 form no part of the present invention.

The present invention includes a V-groove cutting head or carrier 80 which is adapted to be mounted on, and slidably moved along, the matboard cutting machine 30. The cutting head 80 may be provided with any suitable structure for engaging the matboard cutting machine guide rail 60. Further, the V-groove cutting head 80 may be adapted for use with other suitable engaging guide rails on other matboard cutting machines and/or for engaging a simple straight edge member that is not furnished as a part of a matboard cutting machine.

For example, one straight edge or guide bar is illustrated in U.S. Pat. No. 4,158,977. The V-groove cutting head of the present invention may be employed with such a device and/or may be modified as necessary to be employed with other straight edge devices.

Where the V-groove cutting head 80 is to be employed with a cutting machine having a rail or lip 74 as illustrated in FIG. 6, the cutting head 80 preferably includes a base 82 which is adapted to be positioned along one side of the rail 74. Mounted to the base are a pair of guide blocks 84 and 86, and each guide block 84 and 86 defines a downwardly facing channel 88 for receiving the upstanding rail or lip 74 of the guide rail 60. Typically, the base 82 is fabricated from a metallic material, and each guide block 84 and 86 is molded from a suitable thermoplastic material having a relatively low coefficient of sliding friction. The guide blocks 84 and 86 are mounted to the base 82 with socket head screws 85 and 87, respectively (FIG. 2).

Figure 2:
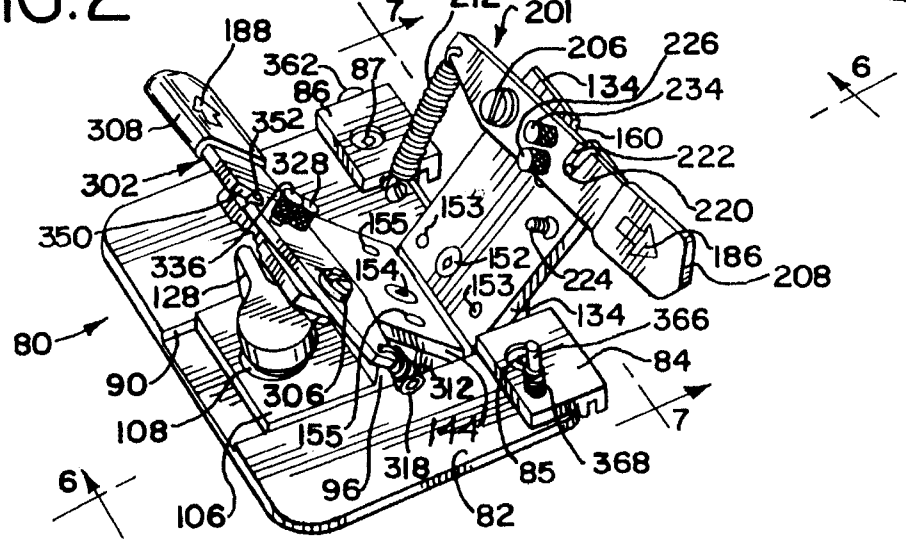
FIG. 2 is a perspective view of the present invention cutting head shown removed from the matboard cutting machine.

As illustrated in FIGS. 2 and 6, the base 82 defines a recess 90 which extends across the width of the base. The base 82 also defines a rectangular opening or slot 92 in one portion of the recess 90 to accommodate a first, fixed mounting block 94 and a second, adjustable mounting block 96. The fixed mounting block 94 has a slanting blade support surface 98, and the adjustable mounting block 96 has a slanting support surface 102.

The bottom front portion of each support block 94 and 96 extends into the slot 92. A portion of each block 94 and 96 extends upwardly out of the slot 92 and is received in the recess 90 on the base 82.

The adjustable block 96 includes a laterally extending flange 106. The flange 106 defines an elongated slot 108 which communicates with a threaded bore 112 in the underlying portion of the base 82. A threaded shank 116 of a screw is threadingly engaged with the base 82 in the bore 112. The shank 116 includes an upper shoulder 118 spaced above the lateral flange 106 of the block 96. A washer 120 is mounted on the shank 116 above the threads and is retained against the block flange 106 by the shank flange 118.

The upper end of the screw shank 116 is provided with vertical ribs 124 for engaging a bore 126 defined in a lever 128. Rotation of the lever 128 (typically about 90°) will, depending upon the direction of rotation, either tighten or loosen the engagement of the support flange 106 between the base 82 and the washer 120. Thus, the lever 128 can be operated to loosen the support flange 106 to permit the block 96 to be moved closer to, or further away from, the fixed block 94.

The fixed block 94 supports a first blade 131 and a first blade guide 134. The block 96 supports a second blade 142 and a second blade guide 144. The second blade 142 and second blade guide 144 are supported on the slanting surface 102 of the block 96. Similarly, the first blade 131 and first blade guide 134 are supported on the slanting surface 98 of the block 94.

As illustrated in FIG. 2, the first blade guide 134 is secured to the block 94 with a socket head screw 152. Two pins 153 extending through the first blade guide 134 into the block 94 prevent the blade guide from pivoting on the block.

Similarly, the second blade guide 144 is mounted to the block 96 with a socket head screw 154. Two pins 155 extending through the second blade guide 144 into the block 96 prevent the blade guide from pivoting on the block.

Figure 7:
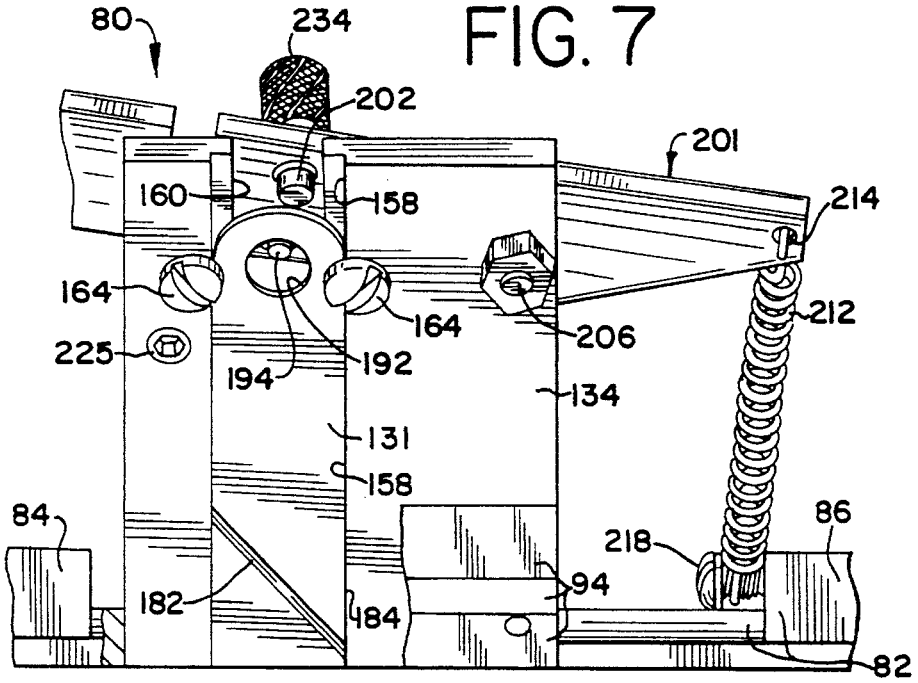
FIG. 7 is a greatly enlarged, fragmentary view taken generally along the plane 7—7 in FIG. 2.

As illustrated in FIG. 7, the back of the first blade guide 134 defines a channel or slot 158 for receiving the first blade 131. As illustrated in FIG. 6, the upper end of the slot 158 includes an elongate aperture 160. The upper end of the first blade 131 is retained adjacent the aperture 160 within the slot 158 by the heads of two screws 164 on opposite sides of the slot 158. Each screw 164 is threaded into a receiving aperture in the first blade guide 134, and the head of each screw 164 extends outwardly over the slot 158 adjacent the first blade 131.

The second blade 142 is mounted in the second blade guide 144 in substantially the same way that the first blade 131 is mounted the first blade guide 134 as described above. However, the second blade 142 is reversed with respect to the orientation of the cutting edge. In particular, as illustrated for the first blade 131 in FIG. 7, the first blade 131 has a tip defined by an angled, leading cutting edge 182 and a trailing edge 184. The cutting edge 182 faces in the direction of the arrow 186 illustrated in FIG. 2.

On the other hand, the second blade 142 has a tip defined between a leading, cutting edge and a trailing edge, but the second blade cutting edge faces in the direction of the arrow 188 in FIG. 2 (i.e., opposite to the direction of the cutting edge 182 of the first blade 131). Further, the distal ends or tips of the two blades are preferably offset from each other by a small amount along the cutting direction as is explained in more detail hereinafter.

The second blade 142 is slidably disposed in a slot 189 (FIG. 6). The upper end of the second blade 142 is retained within the slot 189 by the heads of a pair of screws 191 which are mounted in the same manner as the screws 164 for retaining the first blade 131 described above with reference to FIG. 7.

As illustrated in FIG. 7, the upper end of the first blade 131 defines an aperture 192 for receiving a lower actuating pin 194 projecting from a first operating lever or member 201. A second operating pin 202 extends from the operating lever 201 to engage the upper, distal end edge of the first blade 131.

The operating lever 201 is mounted for pivoting movement to the first blade guide 134 with a pivot screw 206. The operating lever 201 has a handle 208, and the lever 201 is normally biased to hold the handle 208 upwardly by means of a helical tension spring 212 which is engaged at one end with an aperture 214 in the lever 201 and which is engaged at the opposite end with a screw 218 mounted in the guide block 86 on the base 82.

The first blade 131 can be removed from the first blade holder 134 and replaced when necessary. To this end, the lower actuating pin 194 projects from the end of a threaded thumb screw 226 (FIGS. 2 and 6) which is threadingly engaged with a threaded aperture 230 in the first lever 201. Similarly, the upper actuating pin 202 extends from a threaded thumb screw 234 which is threadingly engaged with a threaded aperture 238 in the operating lever 201.

The thumb screws 226 and 234 can be partially unscrewed from the lever 201 to release the blade 131 when desired. The blade 131 can then be removed and replaced.

The spring 212 biases the operating lever 201 against an upper stop pin 220 (FIG. 2) mounted in, and projecting from, the first blade guide 134. The operating lever 201 defines a notch 222 for receiving the upper stop pin 220 which engages the bottom of the notch when the lever 201 is pivoted against the pin 220 by the spring 212.

The handle 208 of the operating lever 201 can be pushed downwardly to drive the first blade 131 downwardly below the carrier base 82. The downward movement of the lever 201 is terminated by a lower stop pin 224 (FIG. 2) which projects from the front surface of the first blade guide 134.

The lower stop pin 224 (FIG. 2) is preferably an eccentric shaft projecting from a socket head screw 225 (FIG. 7). The screw 225 is threadingly engaged with a threaded aperture in the first blade guide 134. The longitudinal axis of the head of the screw 225 and of the receiving aperture in the first blade guide 134 is offset from the longitudinal axis of the pin 224. When the screw 225 is rotated, the offset pin 224 is carried in a circular arc closer to, or further away from, the carrier base 82. Thus, the lowermost position at which the operating lever 201 is stopped by the pin 224 can be adjusted. This controls the depth of penetration of the tip of the first blade 131.

The second blade 142 is controlled and operated by mechanisms which are substantially identical to those described above with respect to the first blade 131. In particular, with reference to FIG. 2, a second operating lever 302 is mounted on the second blade guide 144 with a pivot screw 306. The second lever 302 has a handle 308 at one end, and the handle end of the lever 302 is normally biased upwardly by a helical tension spring 312 which is connected at one end to the lever 302 and at the other end to a screw 318 mounted in the side of the block 96.

With reference to FIG. 6, the upper end of the second blade 142 defines an aperture 322 (analogous to the aperture 192 in the first blade 131 as shown in FIG. 7). The second blade aperture 322 receives a lower actuating pin 326 projecting from the end of a threaded thumb screw 328 threadingly engaged with an aperture 330 in the second lever 302.

An upper actuating pin 334 engages the upper, distal end of the second blade 142. The pin 334 projects from the end of a thumb screw 336 which is threadingly engaged with an aperture 338 in the second lever 302.

The upper edge of the second blade guide 144 defines an aperture 342 around the lower and upper actuating pins 326 and 334, respectively, to accommodate movement of the pins and connected blade 142 upwardly and downwardly as the lever 302 is operated.

The tension spring 312 normally biases the second lever 302 so that the end with the handle 308 is maintained in an uppermost position. To this end, the lever 302 defines a notch 350 (FIG. 2) for receiving an upper stop pin 352 which is mounted in, and projects upwardly from, the second blade guide 144. The upward movement of the second lever 302 is limited by engagement of the lever 302 with the pin 352 at the bottom of the notch 350.

When the second lever 302 is moved downwardly, the bottom edge of the lever 302 engages a lower stop pin 346 so as to terminate the movement of the lever, and hence, of the second blade 142. The lower stop pin 346 projects outwardly from the second blade guide 144 and has an eccentric construction identical to that of the first blade stop pin 224 described above. The stop pin 346 has an offset screw head (not visible in the figures but identical to the first socket head screw 225 from which the first stop pin 224 projects as discussed above with reference to FIG. 7). Rotation of the head of the pin 346 will raise or lower the lower stop pin 346. This determines the maximum insertion depth of the second blade 142.

The cutting head 80 includes adjustable mechanisms for engaging stops at each end of its travel. To this end, and as illustrated in FIGS. 2 and 4, an engaging screw 362 is threadingly engaged in a bore in the guide block 86 at one end of the cutting head 80. The head of the screw 362 projects from the guide block 86 and is adapted to contact a suitable abutment on the cutting machine 30.

In the embodiment illustrated in FIGS. 1 and 4, the conventional cutting head 78 is conveniently employed as an abutment member. The engagement screw 362 on the V-groove cutting head 80 engages the leading end of the conventional cutting head 78.

The conventional cutting head 78 is mounted for movement along the guide rail 60 and includes a releasable clamping mechanism operated by a knob 366. The knob 366 can be rotated in one direction to loosen the clamping mechanism so that the conventional cutting head 78 can be positioned where desired along the guide rail 60. Then the knob 366 can be rotated back in the other direction to clamp the conventional cutting head 78 at the selected position so that the conventional cutting head 78 remains stationary as an abutment while the V-groove cutting head 80 is operated to cut the V-grooves in the matboard as explained in detail hereandafter. The detailed design and operation of the conventional cutting head 78 and its clamping mechanism form no part of the present invention. Indeed, any other suitable abutment device may be employed for engaging the V-groove cutting head screw 362.

The screw 362 can be rotated in one direction or the other to increase or decrease the projection distance of the screw head. This may be employed to provide a very fine adjustment.

It will be appreciated that the V-groove cutting head 80 may also be operated without an abutment for contacting the screw 362 or any part of the V-groove cutting head 80. Of course, if no abutment is provided, considerably more care would have to be exercised in terminating the movement of the V-groove cutting head 80 at the desired location. This can be accommodated by careful observation of the cutting blade tips (as they project down between the cutting blade guides 134 and 144). Alternatively, a selected, fixed dimension between one of the cutting blade tips and a location on the V-groove cutting head 80 (e.g, an edge of the base 82) could be correlated with a pencilmark applied to the matboard surface.

In the preferred embodiment, the V-groove cutting head 80 includes an adjustable engaging member for terminating movement of the cutting head 80 in the direction away from the squaring arm 36. That is, the cutting head 80 includes an adjustable engaging member to engage a suitable abutment as the cutting head 80 is moved along the guide rail 60 in the direction of the arrow 186 (FIG. 1). As illustrated in FIG. 2, the engaging device includes a pin 366.

The pin 366 extends from a threaded screw shank 368 which is threadingly engaged with the guide block 84. The shank 368 terminates in a screwhead accessed through an aligned bore in the base 82. The pin 366 is offset from the longitudinal axis of the screw shank 368. Thus, when the screw is rotated in one direction or the other, the pin 366 is carried in an arc toward or away from the adjacent edge of the cutting head 80. This provides a fine adjustment with respect to engagement with a suitable abutment structure, such as an abutment or stop assembly 370 which is mounted at a desired location along the guide rail 60.

Figure 8:
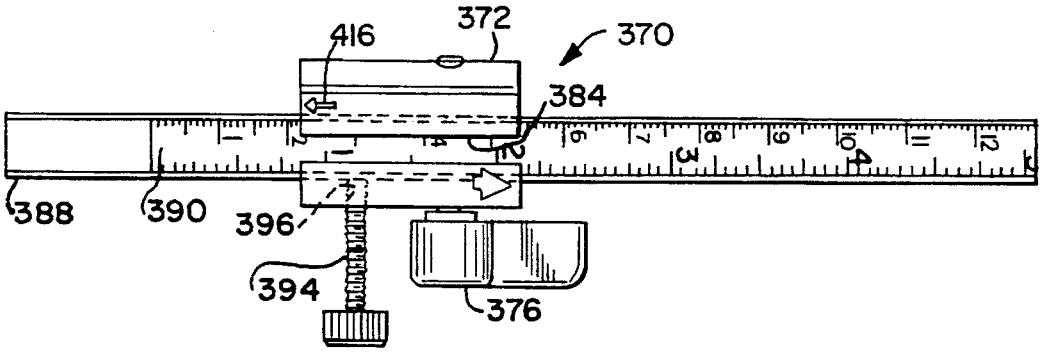
FIG. 8 is a top plan view of the V-groove right-hand end stop.
Figure 9:
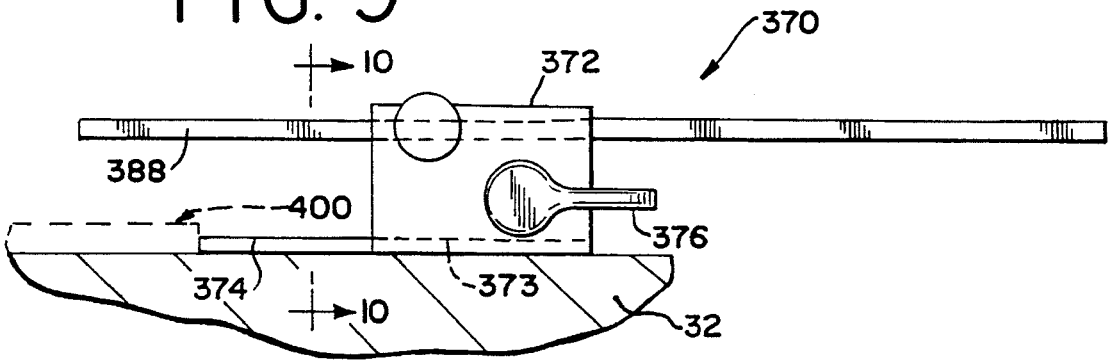
FIG. 9 is a side elevational view of the V-groove right-hand end stop.
Figure 10:
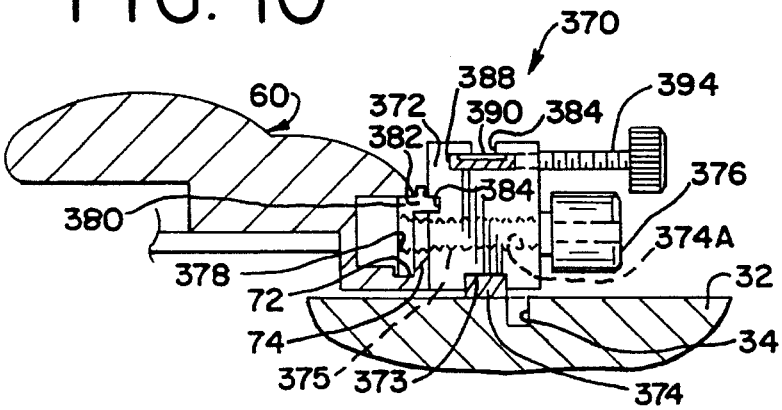
FIG. 10 is a cross-sectional view taken generally along the plane 10—10 in FIG. 9 and further shows portions of the matboard cutting machine engaged with the V-groove end stop.

The stop assembly 370 is illustrated in more detail in FIGS. 8–10 and includes a block 372 having an extending foot 374 (FIGS. 9 and 10). The foot 374 is received in a channel 373 defined in the bottom of the block 372. The bottom surface of the foot 374 engages the upper surface of the cutting machine platform 32 and supports the stop assembly 370 thereon.

The block 370 defines a bore 374A which is not threaded and which receives a threaded shank of an adjustment screw 375 to which is mounted an operating knob or lever 376. The distal end of the screw 375 projects beyond the back of the block 372 and is threadingly engaged with a threaded bore 378 defined in a clamp plate 380. The bottom edge of the clamp plate 380 is received the groove 72 defined in the guide rail 60. The upper portion of the clamp plate 380 has a horizontally projecting flange 382 received in a groove 384 defined in the back of the block 372. When the knob 376 is rotated in one direction, the clamp plate 380 is driven tight against guide rail flange 74 to clamp the block 372 tight against the guard rail 60 and maintain the block 372 stationary on the cutting machine platform 32 at the selected location.

The upper portion of the block 372 defines a slot 384 opening to a wider channel 386 (FIG. 10) for receiving a stop arm 388. The arm 388 has an upwardly facing channel for receiving a scale strip 390 which is mounted in a fixed relationship on the arm 388. The scale strip 390 defines appropriate scale indicia which can be used for correlating or establishing a desired extension of the stop arm 388 relative to the foot 374.

The arm 388 is slidable within the block channel 386 and is releasably engaged by an adjustable clamp or clamping screw 394. The clamping screw 394 is threadingly engaged with the block 372 in an aperture 396 (FIG. 8) defined in the block 372. Rotation of the screw 394 in one direction will clamp the arm 388 in a fixed position in the block 372. Rotation of the screw 394 in the opposite direction will release the arm 388 for sliding to a selected, new position.

The distal end of the arm 388 (the left-hand end of the arm 388 above the foot 374 as viewed in FIGS. 8 and 9) is adapted to contact the engaging pin 366 (FIGS. 2 and 5) on the V-groove cutting head 80.

A preferred form of the novel method of the present invention for cutting of the grooves in a matboard using the V-groove cutting head 80 will next be described with reference to FIGS. 4 and 5, together with the diagrammatic sequence illustrations in FIGS. 11A–11H.

If the V-groove cutting head 80 is employed with a cutting machine, such as the cutting machine 30 illustrated in FIG. 4, then the cutting head 80 is mounted on the guide rail 60 as previously described. Initially, the apparatus components are typically positioned as generally illustrated in FIG. 4. The V-groove cutting head 80 is adapted to be moved along the guide rail 60, from the left-hand end position illustrated in FIG. 4 to the right-hand end position illustrated in FIG. 5, over a matboard 400 which is illustrated in phantom with dashed lines in FIG. 5.

Initially, the guide rail 60 is pivoted upwardly to the matboard-receiving position as illustrated in FIG. 3. The matboard 400 is placed, color side up, on the cutting machine platform 32 with one edge along the mat guide 38 (FIGS. 3 and 5). Preferably, a backing sheet (not illustrated) is placed directly on the platform 32, and the matboard 400 is placed on top of the backing sheet. This is not necessary, however.

The location of the mat guide 38 is adjusted for a desired distance from the blade-receiving groove 34 in the platform 32. For example, if the desired distance of the V-groove to be cut in the matboard is one inch from the edge of the matboard, then the front edge of the mat guide 38 is located one inch from the groove 34. Preferably, a marking scale 404 is provided along the flange 42 and squaring arm 36. The scale 404 is marked in increments (e.g., inches and fractions thereof) with increasing distance from the groove 34 in both directions. Therefore, the front of the mat guide 38 can be conveniently set to a desired distance marking on the scale 404.

The matboard 400 is then pushed tightly against the mat guide 38. The matboard 400 is also positioned so that one edge is tight against the squaring arm 36. Then the guide rail 60 is pivoted back over the mat guide 38 and on top of the matboard 400.

In the preferred method of operation, travel stops or end stops are employed to terminate the travel of the V-groove cutting head 80 at each end of the groove which is being cut in the matboard. With respect to FIG. 4, the left-hand end stop or abutment is defined by the above-described conventional cutting head 78. This is set at a desired location to establish the location of one end of the V-groove that is to be cut in the matboard. The setting is based upon the known distance between the cutting tip of the first blade 131 and the head of the engaging screw 362 on the left-end of the cutting head 80. This is a predetermined distance, subject to fine adjustment by rotating the screw 362. The conventional cutting head 78 can be located at a selected position along the guide rail 60 to establish the desired left-hand end position of the first blade 131 relative to the squaring arm 36 and abutting matboard edge.

To assist in setting the position of the conventional cutting head 78, a marking scale 408 is provided on the edge of the guide rail 60, and the conventional cutting head 78 includes a pointer 410 extending across the scale 408. The markings on the scale 408 are correlated with the distance between the tip of the first blade 131 and the engaging screw 362 so that positioning the conventional cutting head 78 with the pointer 410 at a particular distance marking on the scale 408 will result in the tip of the first blade 131 being positioned an identical distance to the right of the matboard edge adjacent the squaring arm 36. Thus, if it is desired to locate the left-hand end of a groove in the matboard 400 one inch from the left-hand vertical edge of the matboard 400 (as viewed in FIG. 4), then the conventional cutting head 78 is positioned so that the pointer 410 is aligned with the 1-inch mark on the scale 408.

Figure 5:
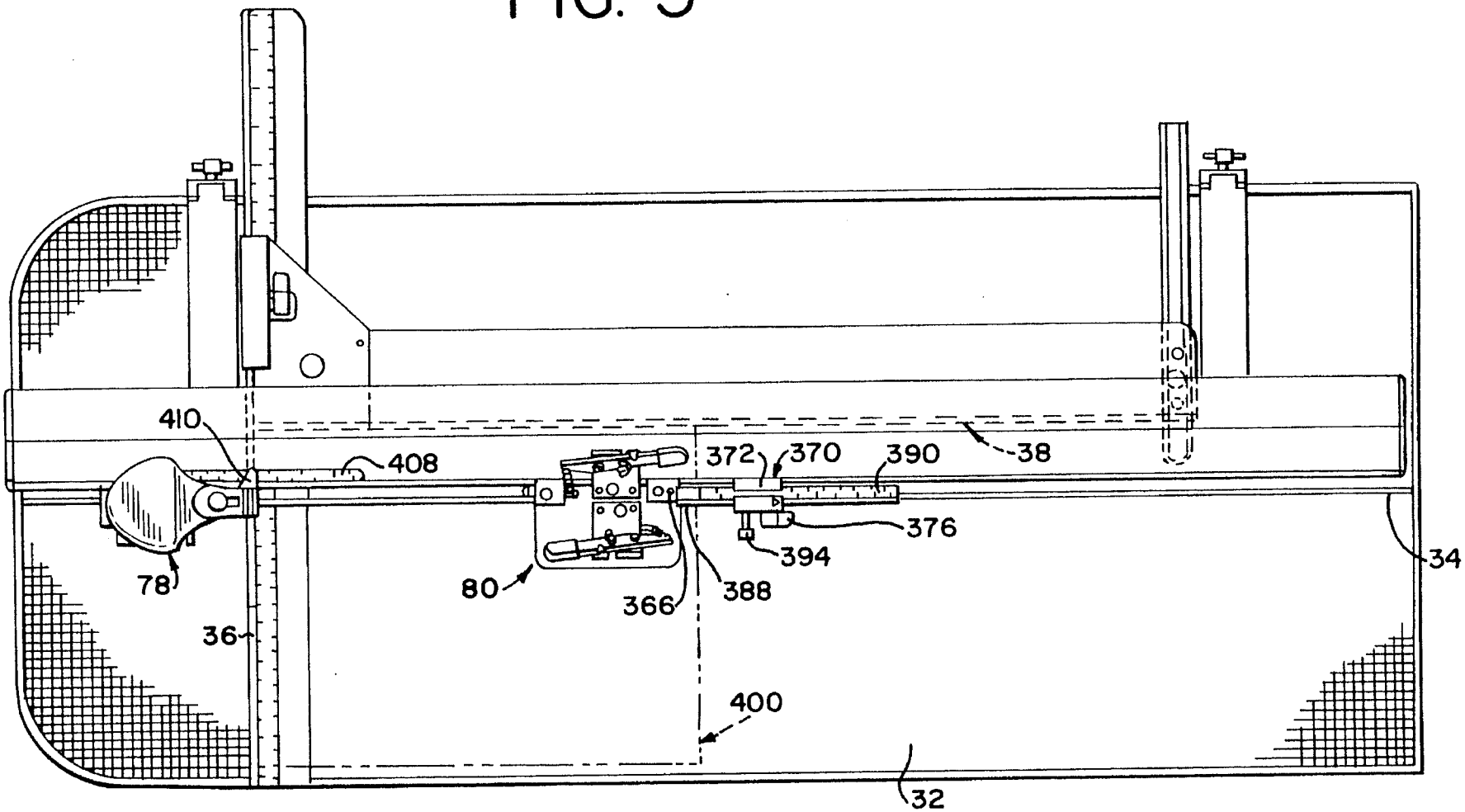
FIG. 5 is a view similar to FIG. 4 showing a matboard in phantom with dashed lines and showing the V-groove cutting head moved from an initial location to a second location adjacent the V-groove right-hand end stop.

With reference to FIG. 5, the right-hand end of the V-groove to be cut in the matboard 400 can be conveniently set by proper positioning of the other abutment or stop assembly 370. As illustrated in FIG. 9, the stop assembly 370 has a lower foot 374 extending toward the matboard 400. The distal end of the foot 374 is positioned in abutting relationship with the right-hand edge of the matboard 400. The stop assembly 370 is then secured in position on the cutting machine platform 32. This is accomplished by rotating the knob 376 to clamp the assembly 370 against the guide rail 60 as described above in detail.

Next, the stop assembly arm 388 is extended to the desired position to engage the stop pin 366 projecting upwardly from the V-groove cutting head 80 (FIG. 5). The distance between the tip of the first blade 131 and the stop pin 366 is a fixed distance (subject to fine adjustment by rotating the pin 366 as explained above). The stop assembly arm scale 390 is designed to take into account the fixed distance between the tip of the blade 131 and the stop pin 366 relative to the matboard edge abutting the end of the stop assembly foot 374. The scale 390 is read at the inside edge of the stop assembly block 372 as indicated by the arrow 416 (FIG. 8). If it is desired to terminate the V-groove one inch from the right-hand edge of the matboard 400 (as viewed in FIG. 5), then the scale 390 is slid within the block 372 until the 1-inch mark aligns with arrow 416 on the block 372. At such a setting, when the stop pin 366 of the cutting head 80 engages the distal end of the stop assembly arm 388, the tip of the first blade 131 will be one inch from the edge of the matboard 400 (i.e., one inch to the left of the right-hand vertical edge of the matboard 400 as viewed in FIG. 5).

Before operating the V-groove cutting head 80, proper, sharp blades 131 and 142 should be installed. Dull blades may be easily removed by loosening the knurled screws 226, 234, 328, and 336 (FIG. 6). This will pull the pins 202 and 194 out of engagement with the first blade 131 and will pull the pins 326 and 334 out of engagement with the second blade 142. The blades 131 and 142 can then be slid upwardly and out of the receiving slots 158 and 162, respectively.

New blades can than be inserted. The first blade cutting edge 182 (FIG. 7) must face in the direction of the first lever handle 208 (FIG. 2), and the second blade 142 cutting edge must face in the opposite direction. Then the screws 226, 234, 328, and 336 can be tightened to establish the connections between the first blade 131 and the first lever 201 and between the second blade 142 and the second lever 302.

Next, the cutting head first operating lever stop pin 224 (FIG. 2) is adjusted to establish the desired penetration depth of the first blade tip. To this end, the pin screw head 225 (FIG. 7) is rotated in one direction or the other to move the eccentrically offset pin 224 (FIG. 2) upwardly or downwardly. The first blade 131 should not completely penetrate the matboard 400, but the depth of penetration should be slightly greater than the depth of penetration of the second blade 142. To this end, the second blade lower stop pin 346 (FIG. 6) is adjusted (in a manner analogous to that described above for the first blade lower stop pin 224). The insertion depth of the second blade 142 can be set to be slightly less than the insertion depth of the first blade 131.

If desired, the width of the V-groove can be varied by moving the second blade support block 96 (with the second blade guide 144 and second blade 142 mounted thereon) closer to, or further away from, the first blade 131. This is accomplished by operating the adjustment knob 128 as described above in detail.

When the desired blade arrangement on the V-groove cutting head 80 is established, the cutting head 80 is mounted on the guide rail 60 as shown in FIG. 4 so that the guide blocks 84 and 86 are properly engaged with the lip or flange 74 of the guide rail 60.

Figure 11A:
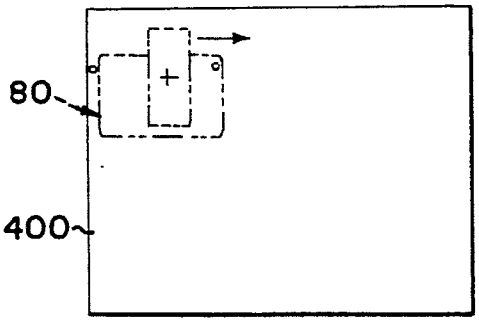
FIGS. 11A–11H are simplified, diagrammatic plan views of the V-groove cutting head shown in phantom with dashed lines on a matboard to illustrate the sequence of operation for cutting grooves in a rectangular configuration.

As illustrated in FIGS. 4 and 11A, the first cut in the matboard is started with the V-groove cutting head 80 against the left-hand abutment, which, in the preferred embodiment illustrated, is the conventional cutting head 78 clamped to the guide rail 60. Then, the base 82 of the V-groove cutting head 80 is pressed down firmly with one hand. The first operating lever 201 is then pressed down (by pushing down at the handle 208 (FIG. 2)). This causes the first blade 131 to be forced downwardly into the matboard to the desired depth (at which point the first operating lever 201 engages the lower stop pin 224). The cutting head 80 is then slid along the guide rail 60 until the right-hand stop assembly 370 is contacted. This makes a first cut 431 (FIG. 11B) in the matboard 400, and the first cut 431 defines the outside, slanted surface of the V-groove.

Next, the first operating lever 201 is lifted to retract the first blade 131 from the matboard 400. Then, while pressure is maintained on the base 82 of cutting head 80, the second operating lever 302 is pressed downwardly until it contacts the stop pin 346 (visible in FIG. 6). This inserts the second blade 142 to the desired depth in the matboard 400.

Figure 11B:
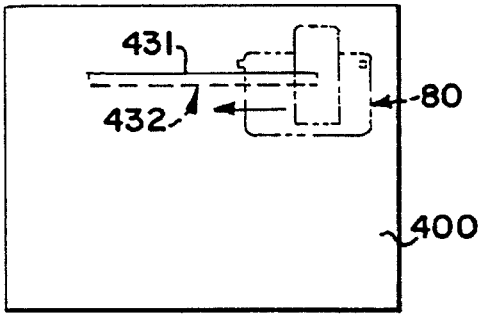

While the second operating lever 302 is held down, the cutting head 80 is moved from the right-hand position illustrated in FIG. 11B back to the initial position. This makes a second cut 432 (illustrated in phantom by dashed lines in FIG. 11B), and the second cut 432 defines the other side of the V-shaped groove.

Figure 11C:
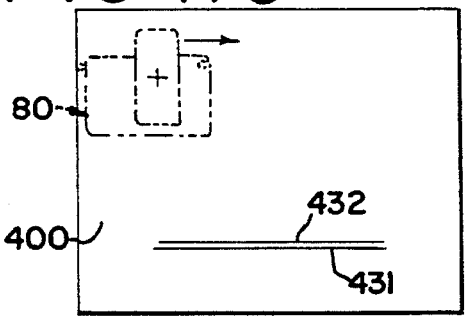
Figure 11D:
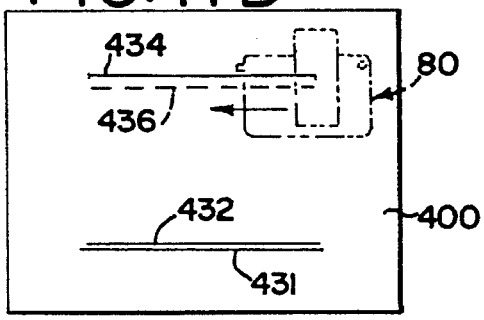
Figure 11E:
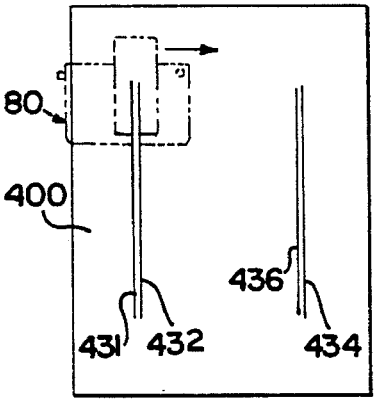

Next, the second operating lever 302 is lifted upwardly to retract the second blade 142 from the matboard. Then the guide rail 60 is lifted upwardly (carrying with it the cutting head 80, stop assembly 370, and conventional cutter 78) so that the matboard 400 can be turned 180 degrees as shown in FIG. 11C. The matboard 400 is positioned against the mat guide 38 and squaring arm 36, and the guide arm 60 is then lowered. The above-described cutting process is then repeated to provide an outside cut 434 and an inside cut 436.

Next, the guide rail 60 is again elevated, and the matboard 400 is then rotated 90 degrees and placed firmly against the mat guide 38 and squaring arm 36. The guide rail 60 is then lowered back on top of the matboard 400, and the cutting head 80 is then in the location illustrated in FIG. 11E. The right-hand stop assembly 370 is then released from engagement with the guide rail 60 and moved toward the left (as viewed in FIG. 4) until the stop assembly foot 374 (FIG. 9) engages the edge of the matboard 400. The stop assembly 370 is clamped at that location.

Figure 11F:
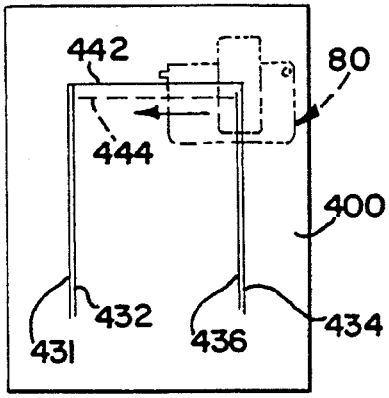

Next, the cutting head 80 is moved along the matboard 400 with the first blade 131 inserted into the matboard until the cutting head 80 engages the right-hand stop assembly 370 at the position illustrated in FIG. 11F. This makes an outside cut 442. Subsequently, after the first blade is retracted and the second blade inserted, the cutting head 80 is moved toward the left back to the initial position to make an inside cut 444.

Figure 11G:
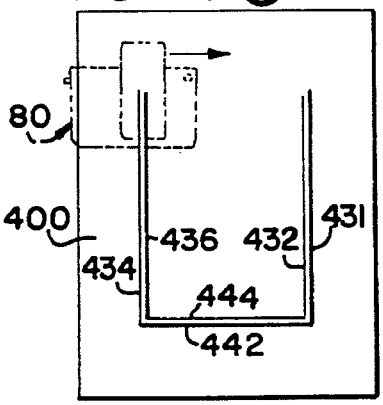
Figure 11H:
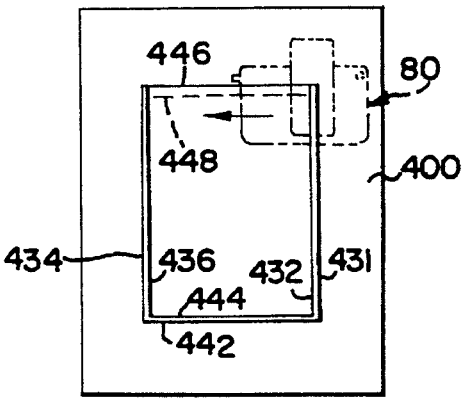

Then the guide rail 60 is again elevated, and the matboard 400 is rotated 180° so that it has the orientation illustrated in FIG. 11G. Next, the guide rail 60 is lowered to position the cutting head 80 at the location illustrated in FIG. 11G. Two more cuts, an outside cut 446 and an inside cut 448, are then made by moving the cutting head 80 first to the right-hand position illustrated in FIG. 11H and then back to the original position.

After all of the cuts have been made, the matboard material between each pair of cuts is readily removed. For example, the matboard 400 can be inverted so that the cut material falls away from the matboard to expose the V-grooves which define a generally rectangular configuration.

Because the preferred form of the V-groove cutting apparatus 80 employs two blades which have the cutting edges offset from each other relative to the length of the groove, the grooves are created without "overcuts" extending into the matboard surface at the corners of the rectangle. This is explained in more detail below with reference to FIGS. 12–14.

Figure 12:
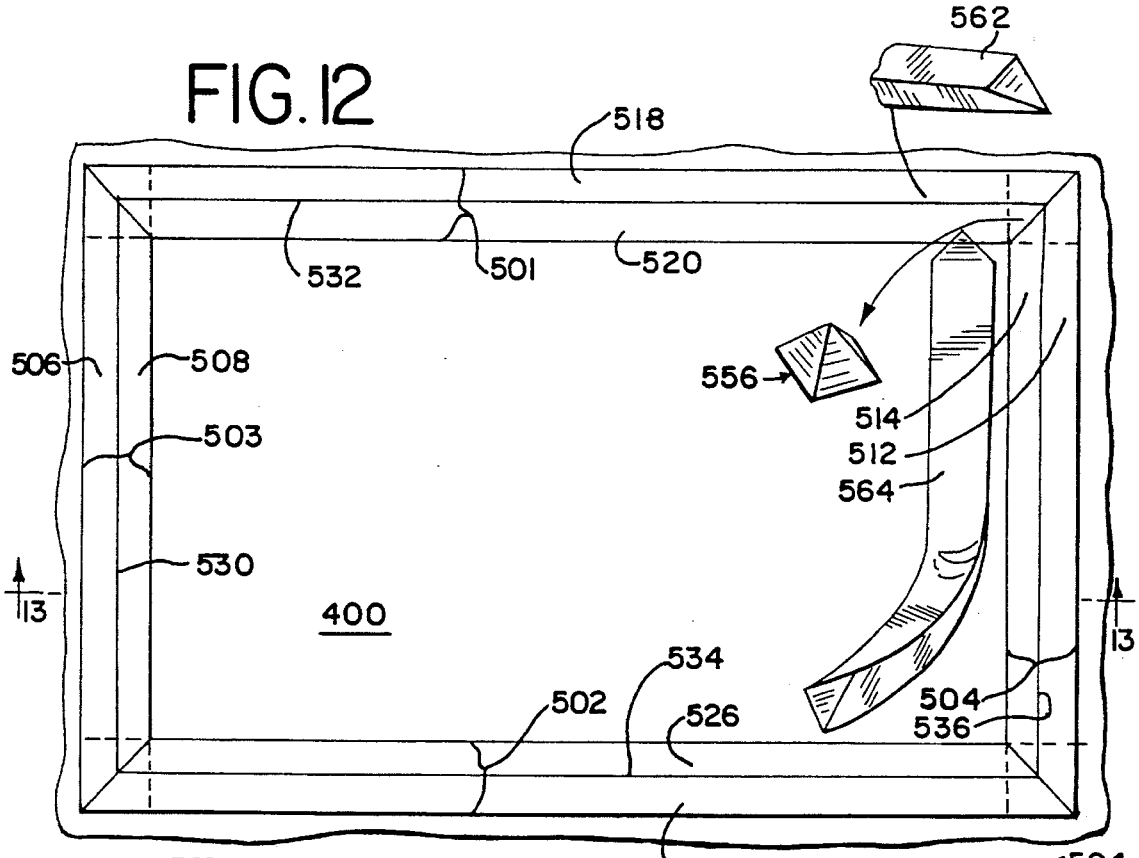
FIG. 12 is a plan view of a matboard with four V-grooves cut therein to define a rectangular configuration.
Figure 13:
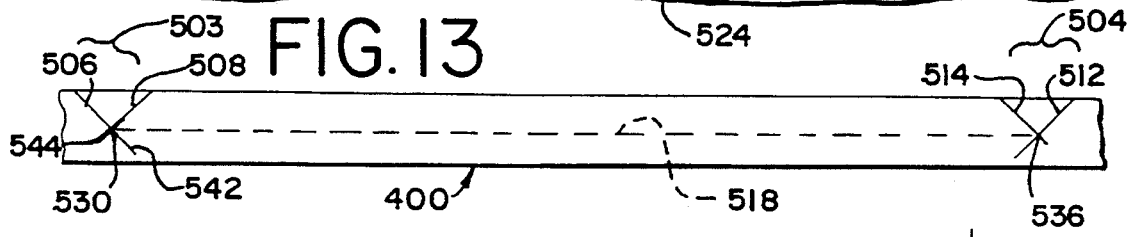
FIG. 13 is a cross-sectional view taken generally along the plane 13—13 in FIG. 12.

In particular, FIG. 12 diagrammatically illustrates four V-grooves defining a rectangular configuration. The rectangular configuration includes a first groove 501, a second groove 502, a third groove 503, and a fourth groove 504. Each groove has an angular, transverse, cross-section (FIG. 13) defined by two flat surfaces. As shown in FIG. 13, the groove 503 has an outside, slanting surface 506 and an inside slanting surface 508. The groove 504 has an outside slanting surface 512 and an inside slanting surface 514. The groove 501 has an outside slanting surface 518 and an inside slanting surface 520. The groove 502 has an outside slanting surface 524 and an inside slanting surface 526.

As shown in FIG. 13 for the groove 503, the slanting surfaces 506 and 508 diverge from a line 530 that is parallel to, but below the face of, the matboard 400. Similarly, the bottom of the groove 501 is defined by a line or line segment 532, the bottom of the groove 502 is defined by a line or line segment 534, and the bottom of the groove 504 is defined by a line or line segment 536. As can be seen in FIG. 13, the V-shaped grooves are defined by the slanting surfaces which have opposite, but equal, angles relative to the matboard surface so that the line defining the bottom of each groove lies along the middle of each groove. It will be appreciated however, that if the cutting head is arranged to support the cutting blades at unequal angles, a non-symmetric V-groove may be created.

With reference to FIG. 13, it can be seen that the outside slanted surface 506 of the groove 503 is defined by a cut which has an extending portion 542 in the matboard 400. Similarly, the inside slanting surface 508 is defined by a cut having an extending portion 544 in the matboard 400. The extending cut portion 542, which is created by the first blade 131, is longer, and extends deeper than, the extending cut portion 544 which is created by the second blade 142.

It is important to note that the cut portions 542 and 544 intersect so as to ensure that the matboard material within the groove 503 is cleanly and completely severed. This provides the groove 503 with a smooth, and aesthetically pleasing, surface configuration. Further, this enables removal of the cut material from the groove without requiring pulling or tugging of material which would create tears along the bottom of the groove 503. The other three grooves have an identical, improved structure.

Figure 14:
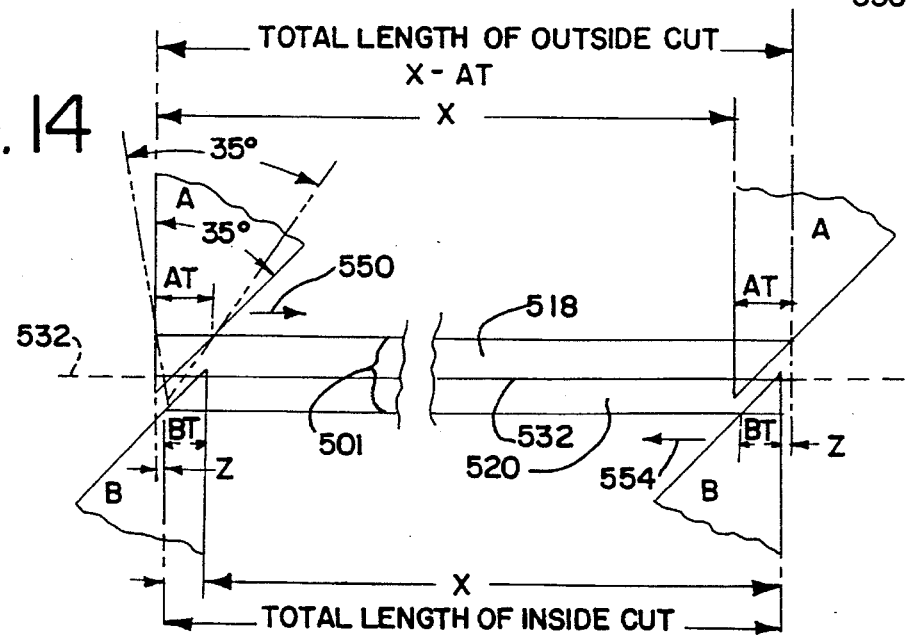
FIG. 14 is a greatly enlarged, diagrammatic, plan view of a groove with cutting blades positioned therein and with certain proportions greatly exaggerated for ease of illustration.

The relationship of the cutting blades, in a preferred arrangement, is diagrammatically illustrated in FIG. 14 with reference to the groove 501. The blade for making the outside cut, which corresponds to the blade 131 illustrated in FIG. 6, is designated by the reference letter A. The blade for making the inside cut, which corresponds to the second blade 142 illustrated in FIG. 6, is designated by the reference letter B.

At the left-hand end of the groove 501 (as viewed in FIG. 14), the outside blade A is inserted into the matboard to the desired depth (so that it extends at least somewhat beyond the middle of the groove defined by the bottom line 532). At that depth, the width of the blade A which intersects the surface of the matboard (at the top of the groove) is designated by the dimension AT. Preferably, the outside blade A is oriented with the cutting edge angled along the cutting direction indicated by the arrow 550 in FIG. 14, and the trailing edge of the blade A is oriented so that it is generally perpendicular to the groove bottom line 532. Preferably, the trailing edge of blade A is initially located on a plane that is perpendicular to the matboard surface at the end of the groove. In any event, the trailing edge of the blade A does not cut into the matboard surface beyond the left-hand end of the groove.

The total length of the outside cut may be characterized as being equal to the blade width AT along the surface of the matboard plus the movement distance of the blade (i.e., as the cutting head 80 is moved from the initial, left-hand position illustrated in FIG. 1 to the right-hand position illustrated in FIG. 5). As shown in FIG. 14, when the outside blade A is moved to the right-hand position at the end of the groove, the leading, angled, cutting edge of the outside blade A intersects the surface of the matboard precisely at the end of the groove. The leading, cutting edge of blade A does not extend beyond the outside edge of the groove, and thus there is no "overcut" in the surface of the matboard beyond the end of the groove.

On the other hand, the inside blade B (corresponding to the second blade 142 illustrated in FIG. 6) is reversed in orientation compared to the outside blade A. Further, the tip of the inside blade B is offset from the tip of the outside blade A relative to the length of the groove (relative to the line 532 defining the bottom of the groove).

After the outside blade A has been inserted into the matboard, moved along the matboard to cut the surface 518 along the groove, and then retracted, the inside blade B is extended or inserted into the matboard at the right-hand end as illustrated in FIG. 14. However, as can be seen in FIG. 14, the inside blade B is located a small distance Z from the right-hand end of the groove 501. The inside blade B is inserted perpendicularly to the groove bottom line 532 until the inside blade tip extends below the groove bottom line 532. This will ensure a complete severing of the matboard material within the groove 501. The width of the extended inside blade B as measured at the surface of the matboard is designated by the distance BT in FIG. 14. The width BT of the blade B at the matboard surface is less than the width AT of the blade A at the matboard surface.

The cutting head, with the extended inside blade B, is then moved in the direction of the arrow 554 to the left-hand position illustrated in FIG. 14. When the cutting head is moved from right to left, the inside blade B is moved the same distance X as was the outside blade A when the cutting head moved from left to right. However, because the inside blade B is offset relative to the outside blade A, and because the inside blade B has a width BT at the surface of the matboard which is less than the outside blade width AT at the surface of the matboard, the cutting edge of the inside blade B does not extend all the way to the left-hand end of the groove when the inside blade B is moved the distance X with the cutting head. Thus, at the left-hand end of the groove, there is an uncut distance Z between the end of the groove and the cutting edge of the inside blade B.

In the preferred blade arrangement indicated in solid lines in FIG. 14, the inside blade B is offset relative to the outside blade A such that the distance Z is about one-half of the difference between the total length of the outside cut and the total length of the inside cut.

The uncut segment Z of matboard material at each end along the inside of the groove 501 is ultimately severed from the matboard by the outside cuts of the two transverse grooves 503 and 504 (FIG. 12) which are subsequently made in the matboard. For example, when the groove 504 (FIG. 12) is cut into the right-hand end of the groove 501, the material within the corner of the groove is completely severed from the matboard, and this material has the form of a pyramid-shaped piece 556 (FIG. 12).

After all four grooves have been cut, all of the matboard material that previously filled in the grooves is completely severed and loose. At each corner, there are four pyramid-shaped pieces such as the piece 556. Further, within each groove there is a completely severed long strip, such as the strip 562 from the groove 501 and the strip 564 from the groove 504. The strips have a generally triangular, transverse cross-section and easily fall out of the matboard when the matboard is inverted.

Preferably, for purposes of convenience, the outside blade A and inside blade B are identical. In one preferred embodiment, the blade angle (i.e., the included angle between the cutting edge and the trailing edge) is 35°. In the preferred method of operation, the outside blade A is inserted into the matboard relatively far, but without penetrating the back of the matboard. In contrast, the inside blade B is inserted into the matboard as shallow as possible, but at least far enough to intersect the cut made by the outside blade A.

For ease of construction and operation, each blade A and B is arranged with the trailing edge oriented generally perpendicular to the length of the groove (i.e., perpendicular to the length of the line 532 defining the bottom, or apex, of the groove 501). However, it will be appreciated that, if desired, the blades could be tilted somewhat. For example, FIG. 14 shows a tilted orientation of the outside blade A in phantom with dashed lines. Even when tilted, however, the outside blade A can be inserted such that the trailing edge of the blade (the left-hand edge of the blade A) does not extend beyond the left-hand end of the groove to be cut so as to avoid making an overcut in the matboard surface.

In view of the above discussion, it will be appreciated that a preferred form of the method for cutting a groove includes orienting a first blade A in a plane that contains a line or line segment that has two ends and that is located parallel to, but below the face of, the matboard and that will lie at the bottom of the groove to be defined by two flat surfaces diverging from the line segment. The plane of the blade A is at an oblique angle relative to the matboard face, and that oblique angle defines the angle of the outside face of the V-groove to be cut. The outside blade A is located adjacent one end of the line segment and inserted into the matboard until the blade tip extends below the line segment with the trailing edge of the blade intersecting the matboard surface at a point in a plane that is located at the end of the line segment and oriented perpendicular to the line segment. The outside blade A is then moved along the line segment 532 to make linear cut in the matboard until the intersection of the cutting edge of the blade A with the matboard surface defines a point in a plane that is located at the extreme right-hand end of the groove and that is oriented perpendicular to the line segment 532.

After the outside blade A is retracted, the other side of the groove can be cut with second blade B located adjacent a selected end of the line segment 532. The second blade B is oriented in a plane that contains the line segment 532 and that is at an oblique angle relative to the matboard surface. The second blade B is inserted into the matboard until the second blade tip extends below the line segment 532 with the trailing edge spaced inwardly of the end of the groove.

As shown in the right-hand portion of FIG. 14, the trailing edge of the second, inside blade B is spaced inwardly a distance Z from the right-hand end of the line segment 532 as measured at the matboard surface.

The second, inside blade B is moved along the line segment 532 to make a second linear cut in the matboard until the blade's cutting edge is spaced a distance Z from the left-hand end of the line segment 532. For a symmetric V-groove, the spacing distance Z is less than ½ of the width of the groove as measured at the matboard surface. The inside blade B is then removed from the matboard.

In other forms of the blade operation, the outside blade A and inside blade B need not be offset. However, preferably, one of the blades would first be inserted and moved along the matboard to make a first cut. Subsequently, the blade would be retracted from the matboard and the second blade would be inserted and moved along the matboard to make the second cut. In such a form of operation, the blades could be provided with differing blade angles and/or one of the blades could be moved along the matboard a distance less than the movement distance of the other blade so as to avoid creating an overcut in the matboard surface beyond the ends of the groove. However, in those applications where such an overcut is not unacceptable, such operational requirements may be eliminated.

Also, it will be appreciated that in another form of operation, both the outside blade A and inside blade B could be oriented with the angled cutting edges facing the same direction, but with the blades offset lengthwise along the length of the groove to be cut. This will permit one blade to extend across the cutting plane of the other to ensure that the matboard material at the bottom of the groove is completely and cleanly severed. The material in the corners of each groove would be completely severed by the transverse groove cuts.

In any event, a preferred method of inserting the blades into the matboard requires that the blades be inserted generally perpendicularly relative to the length of the groove to be cut while the cutting head is stationary. This permits at least one of the blades (e.g., the outside blade) with a straight, trailing edge to be inserted at an extreme end of the groove without creating overcuts in the matboard surface beyond the groove end.

Figure 15:
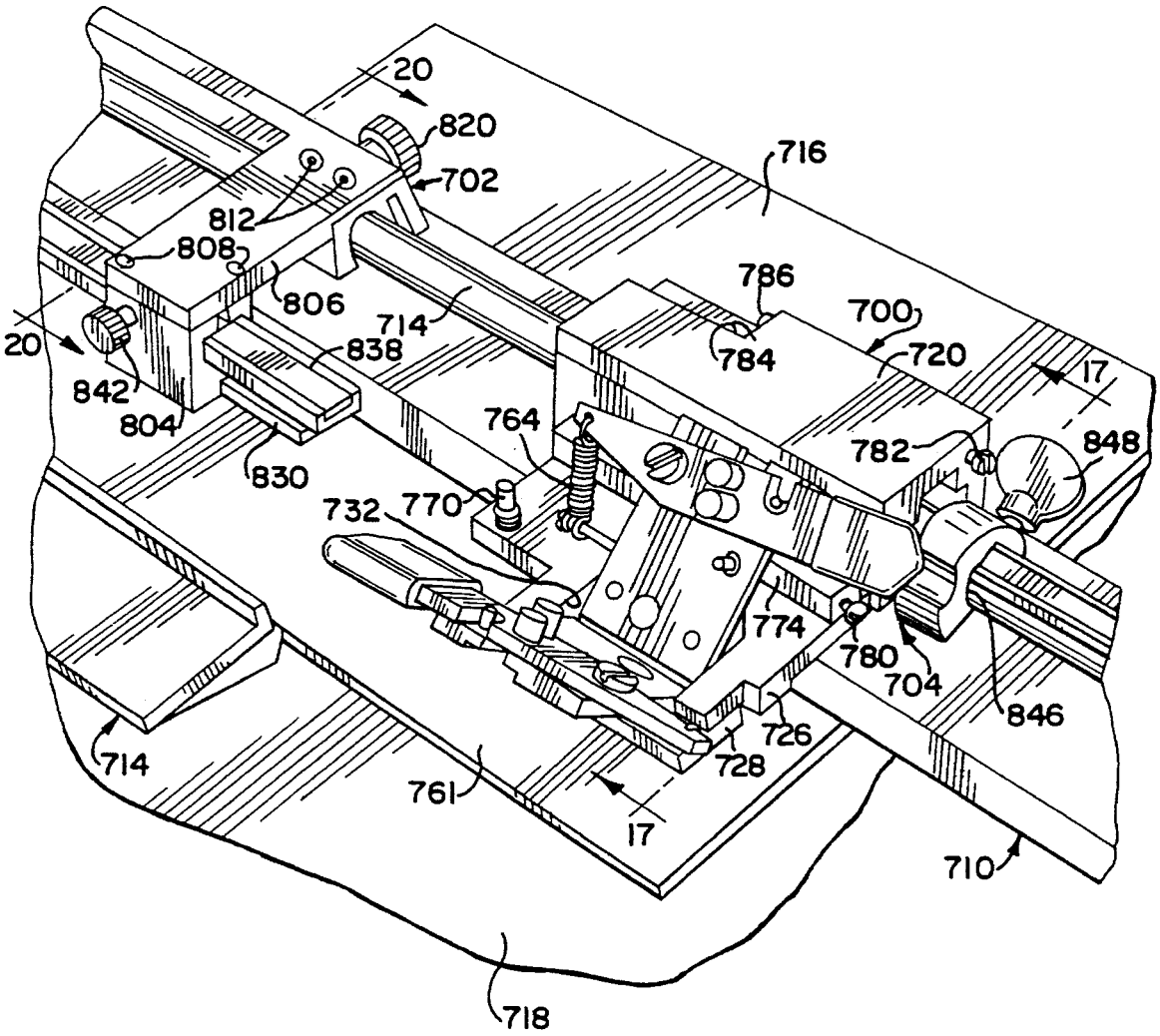
FIG. 15 is a fragmentary, perspective view of an alternate embodiment of a V-groove cutting head and V-groove stop shown mounted on a guide rail of another type of matboard cutting machine.
Figure 16:
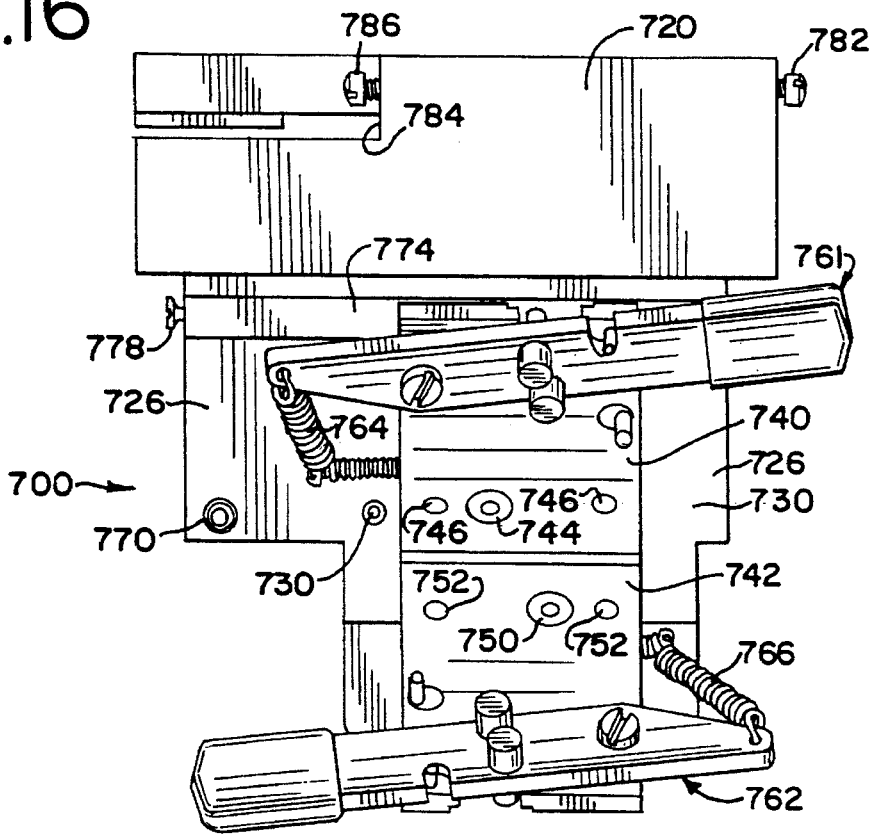
FIG. 16 is an enlarged, plan view of the V-groove cutting head illustrated in FIG. 15.
Figure 17:
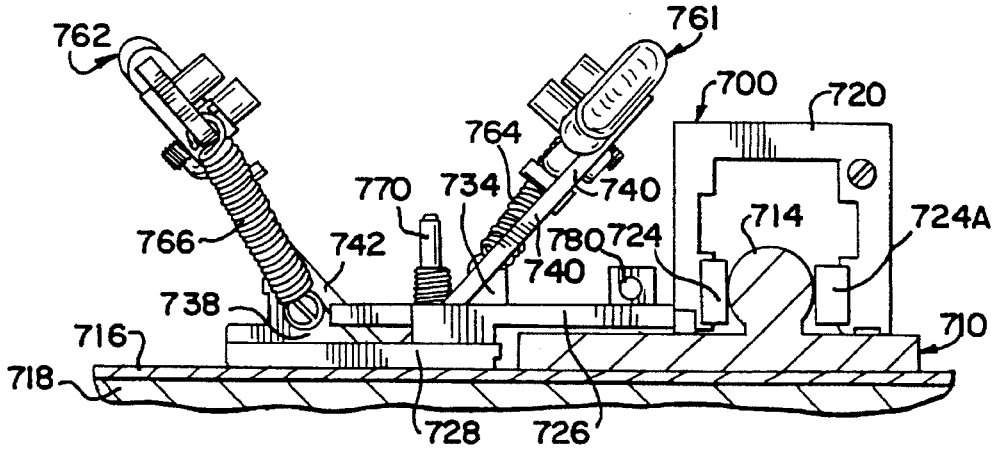
FIG. 17 is a fragmentary, cross-sectional view taken generally along the plane 17—17 in FIG. 15.
Figure 18:
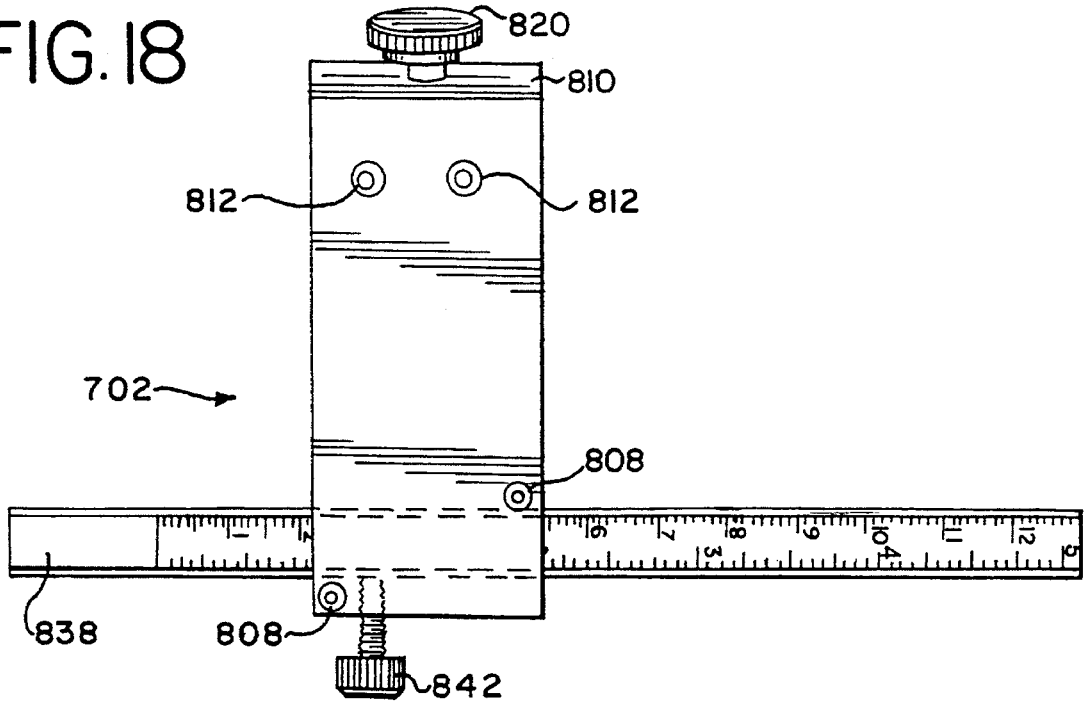
FIG. 18 is a greatly enlarged, plan view of the V-groove stop illustrated in FIG. 15.
Figure 19:
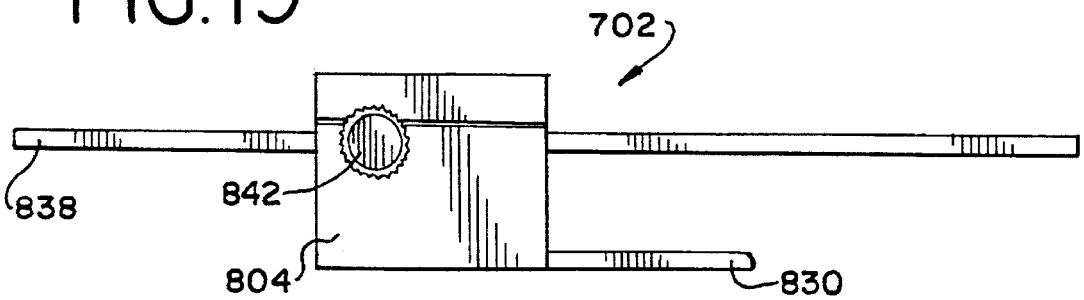
FIG. 19 is a side elevational view of the stop illustrated in FIG. 18.

Another embodiment of a cutting head according to the principles of the present invention is illustrated in FIGS. 15–17 for use on a different type of cutting machine with alternate stop assemblies. The alternate embodiment of the cutting head is designated generally by the reference numeral 700 in FIG. 15, and the alternate stop assemblies are designated generally by the reference numerals 702 and 704 in FIG. 15. The stop assemblies and cutting head are illustrated in FIG. 15 as employed with another form of a matboard cutting machine having a guide arm 710 on which is mounted a guide rail 714 and a mat guide 715. A matboard 716 is disposed under the guide arm 710 and against the mat guide 715. The matboard 716 is supported on a platform 718 of the mat cutting machine.

As illustrated in FIGS. 15–17, the V-groove cutting head 700 includes a guide housing 720 defining an internal cavity for receiving the guide rail 714. Mounted within the housing 720 are blocks 724 and 724A which engage the rail 714 on opposite sides. The blocks 724 and 724A are preferably fabricated from a suitable material, such as nylon, having a relatively low coefficient of sliding friction.

Extending from the housing 720 is an upper base 726. Extending from the upper base 726 is a lower base 728. The lower base 728 is mounted to the bottom of the upper base 726 with suitable machine screws 730 (FIG. 16).

The upper base 726 defines a U-shaped cutout 732 (FIG. 15), and the lower base 728 defines an aperture (not visible in the figures) in registry with the U-shaped cutout 732. A first support 734 (FIG. 17) is mounted within the upper base cutout 732 on the lower base 728, and a lower portion of the support 734 extends into the aperture in the lower base 728.

A second support 738 (FIG. 17) is mounted on the lower base 728 in spaced relationship from the first support 734. A lower portion of the second support 738 extends into the aperture in the lower base 728.

The first support 734 has a slanted support surface for supporting a first blade in a first blade guide 740. Similarly, the second support 738 has a slanted surface for supporting a second blade in a second blade guide 742.

As illustrated in FIG. 16, the first blade guide 740 is mounted to the support 734 with a screw 744. Pins 746 extend from the support 734 into the blade guide 740 to prevent rotation of the blade guide 740. Similarly, the second blade guide 742 is mounted with a screw 750 to the underlying support 738. Pins 752 extend from the support 738 into the second blade guide 742 to prevent rotation of the second blade guide 742.

The first blade support 738 is mounted to the lower base 728 with a screw (not visible), and the lower base 728 defines an elongated slot for the screw to permit lateral adjustment of the second blade support 738 relative to the first blade support 734. That is, the second support 738 may be moved closer to, or further away from, the first support 734. This permits adjustment of the width of the groove which is cut by the blades in the blade guides.

Each blade guide 740 and 742 has a structure substantially identical to the blade guides 134 and 144, respectively, described above with reference to the first embodiment of the V-groove cutting head 80 illustrated in FIGS. 1–7. The guides 740 and 742 each slidably receive a blade which is connected with, and operated by, a first operating lever 761 and a second operating lever 762, respectively.

The lever 761 is mounted to the first blade guide 740 and biased to a blade-retracting position by a tension spring 764. The second operating lever 762 is mounted to the second blade guide 742 and is biased to a blade-retracting position by a tension spring 766. The means for mounting the operating levers to the blade guides and for connecting the levers to the blades are identical to those described above for the first embodiment of the cutting head 80 illustrated in FIGS. 1–7. Upper and lower travel stops are provided on the blade guides for limiting the pivoting movement of the operating levers in the same manner as described above with reference to the first embodiment of the cutting head 80 illustrated in FIGS. 1–7.

The cutting head 700 also includes engaging means on each end for engaging a suitable stop assembly or abutment to terminate movement of the cutting head at each end of the groove that is to be cut in the matboard. Specifically, with reference to FIGS. 15–17, an adjustable engaging pin 770 is provided at one end of the upper base 726. The pin 770 has an offset structure which is identical to the structure of the engaging pin 366 described above with reference to the first embodiment of the cutting head 80 illustrated in FIGS. 1–7. The eccentric engaging pin 770 can be rotated about a central longitudinal axis to provide a fine adjustment in the same manner as described above for the engaging pin 366.

The cutting head 700 includes additional engaging structures on a bar 774 which is mounted to the top surface of the upper base 726 adjacent the housing 720. With reference to FIG. 16, a horizontally disposed engaging screw 778 is mounted in the left-hand end of the bar 774. The screw 778 may be employed as an alternate engaging structure for engaging a suitable left-hand end abutment. Depending on the type of abutment employed at the left-hand end of the groove, either the pin 770 or the screw 778 may be more suitable.

At the other end of the cutting head 700 there is a horizontally disposed engaging screw 780 (FIG. 15) which is threadingly engaged with the bar 774.

Both the screw 780 and the screw 778 can be adjusted to vary the distance by which the screw head projects from the bar 774 to provide a fine adjustment with respect to a stop assembly or other abutment structure that would be engaged by the screw head at the end of the cut or groove being formed in the matboard 720.

Additional adjustment screws can also be provided on the housing 720. For example, on the right-hand end of the housing 720, a screw 782 is threadingly engaged with the vertical, side surface of the housing. The screw 782 may be used instead of the screw 780 for engaging a stop assembly or other abutment, depending upon the particular configuration of such a stop assembly or abutment.

The other end of the housing 720 has a notched area 784 (FIGS. 15 and 16), and an engaging screw 786 is mounted in a vertical wall of the notch. The screw 786 may be used as an alternative to the pin 770 and screw 778, depending upon the particular structure of the stop assembly or abutment to be engaged at the left-hand end of the cutting head 700.

Figure 20:
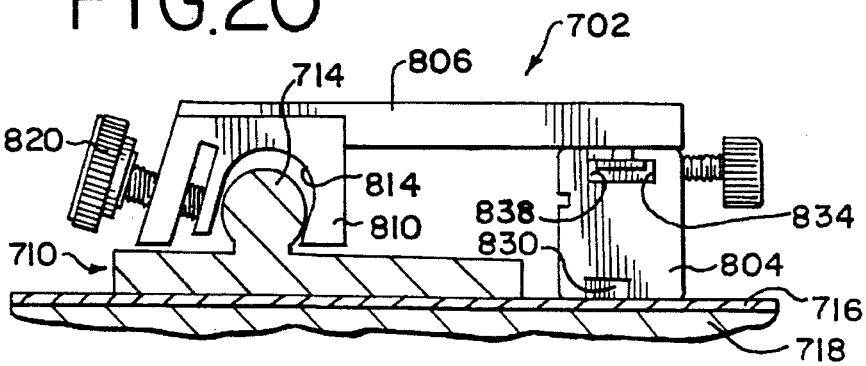
FIG. 20 is a greatly enlarged, fragmentary, cross-sectional view taken generally along the plane 20—20 in FIG. 15.

The stop assembly 702 illustrated in FIGS. 15 and 18–20 is adapted to be engaged by the engaging pin 770 on the cutting head 700. As illustrated in FIGS. 15 and 20, the stop assembly 702 includes a block 804, a bridge 806 mounted to the top of the block 804 with socket head screws 808, and a sleeve 810 secured to the bridge 806 with socket head screws 812. As illustrated in FIG. 20, the sleeve 810 defines a recess 814 for receiving the rail 714. A thumb-screw 820 is threadingly engaged with the sleeve 810 and can be turned to clamp or release the guide rail 714.

The block 804 includes an outwardly projecting foot 830 for supporting the block on the platform 718 or on the top of the matboard 716. However, preferably, the stop assembly 702 is positioned adjacent the edge of the matboard 716 (not on top of the matboard 716 as illustrated in FIG. 15) so that the distal end of the foot 830 may be butted against the edge of the matboard to establish a reference position in the same manner as described above with reference to the foot 374 of the first embodiment of the stop assembly 370 illustrated in FIGS. 8–10.

As illustrated in FIG. 20, the block 804 defines a slot 834 for slidably receiving a scale bar 838. The position of the scale bar 838 within the block 804 can be adjusted, and the scale bar 838 can be clamped in a selected position by a thumb screw 842 which is threadingly engaged with the block 804 and which has a distal end adapted to contact the side of the scale bar 838.

The scale bar 838 may be used to contact a suitable engaging pin or member on the cutting head 700, such as the engaging pin 770. The scale bar 838 may be employed to set one end-of-travel position of the cutting head 700 in the same manner as described above with reference to the scale bar 388 of the first embodiment of the stop assembly 370 illustrated in FIGS. 8–10.

Other forms of stop assemblies may be employed if desired. For example, FIG. 15 illustrates the stop assembly 704 on the right-hand end of the cutting head 700. The stop assembly 704 defines a recess 846 for receiving the guide rail 714. A thumb screw 848 is provided for clamping the stop assembly 704 at a selected position on the guide rail 714. The vertical end wall of the block 720 of the cutting head 700 can engage the stop assembly 704 to terminate the movement of the cutting head 700 at the right-hand end of the cut or groove in the matboard 716. If desired, an adjustable, engaging screw, similar to the screws 780 and 782, could be provided in the vertical end wall of the block 720 in registry with the stop assembly 704. The stop assembly 704 would thus be engaged by such a screw, and such a screw would provide a fine adjustment capability.

Of course, it will be appreciated that in some applications, stop assemblies at each end of the cutting head 700 may be eliminated. The operator would then move the cutting head 700 along the matboard to locations determined solely by observation, with or without the existence of pencil marks previously applied to the matboard surface.

The cutting edges of the two blades in the cutting head 700 face in opposite directions. Similarly, the cutting edges of the two blades in the first embodiment of the cutting head 80 face in opposite directions. This permits the V-groove to be efficiently created by cutting one side of the V-groove while moving the head in one direction and then cutting the other side of the V-groove while moving the head back in the reverse direction. However, it will be appreciated that each cutting head could be modified to hold both blades with the cutting edges facing in the same direction. The method of operating each cutting head could be changed to accommodate the modification.

In particular, with the cutting head positioned at an initial, first end location, one blade is inserted into the matboard. The head is then moved (with the blade edge leading) along the matboard to make a first angled cut (between the first end location and a selected second end location), and that cut defines one face of the V-groove. Then the blade is retracted, and the head is moved back to the initial location (without making a cut).

Subsequently, the second blade is inserted into the matboard at the initial location, and the cutting head is moved along the matboard toward the second end location to make the second, angled cut defining the other face of the V-groove. The depth of the blade insertion is such that the cuts intersect to completely sever the matboard material in the V-groove.

To avoid making overcuts in the matboard surface at each end of the groove, the size, shape, and arrangement of the blades can be selected, and the head travel controlled, so that the blades do not cut beyond the groove ends during operation.

It is readily apparent from the foregoing detailed description of the invention and from the illustrations thereof that numerous variations and modifications may be effected without departing from the true spirit and scope of the novel concepts or principles of this invention.

What is claimed is:

1. A method for cutting a plurality of decorative grooves, which each define a side of a polygon, in a face of a matboard wherein (1) each groove has (a) a V-shaped transverse cross-section defined by two flat surfaces diverging from an associated one of a plurality of line segments which are arranged in the form of said polygon and wherein each line segment has two ends and lies below the face of said matboard; and (b) a width measured at the face of said matboard surface normal to the length of said associated line segment; and (2) the face of said matboard remains uncut beyond said grooves, said method comprising the steps of:

(A) providing first and second planar blades each having an angled tip defined by a leading cutting edge and a trailing edge;

(B) orienting the first blade in a plane that contains one of the line segments and that is at an oblique angle relative to said matboard face, (C) locating the first blade adjacent an end of said one line segment;

(D) inserting said first blade into said matboard until said first blade tip extends below said one line segment with said trailing edge intersecting said matboard face along a plane perpendicular to and at said and of said one line segment;

(E) moving said first blade along said one line segment to make a first linear cut in said matboard until the intersection of said cutting edge with said matboard face defines a point lying in a plane perpendicular to the other end of said one line segment;

(F) removing said first blade from said matboard;

(G) orienting the second blade in a plane that contains said one line segment and that is at an oblique angle relative to said matboard face;

(H) locating the second blade adjacent a selected one of the two ends of said one line segment;

(I) inserting said second blade into said matboard until said second blade tip extends below said one line segment with said trailing edge located between the two ends of said one line segment and spaced from said selected end of said one line segment by a distance of less than one-half of the width of the groove as measured at said matboard face;

(J) moving said second blade along said one line segment to make a second linear cut in said matboard until the second blade cutting edge is spaced from the other one of the two ends of said one line segment by a distance less than one-half of the width of the groove as measured at said matboard face;

(K) removing said second blade from said matboard; and (L) repeating steps (B)–(K) for each remaining side of said polygon.

2. The method in accordance with claim 1 in which steps (B) and (G) include orienting said blades to each lie in separate planes that intersect to define a generally V-shaped configuration above one of said line segments.

3. The method in accordance with claim 1 in which step (I) includes inserting said second blade with said trailing edge perpendicular to said one line segment.

4. A method for providing a matboard with first and second cuts from between which a portion of the matboard can be removed to define a decorative, linear groove having a predetermined length measured along said first cut in a face of the matboard between predetermined first and second parallel end planes perpendicular to the matboard face, said method comprising the steps of:

(A) disposing said matboard adjacent a blade carrier positioned at a first location and on which is mounted (1) a first blade having a tip defined by a trailing edge oriented toward said first end plane and by an angled cutting edge oriented toward said second end plane and (2) a second blade having a tip defined by a trailing edge oriented toward said second end plane and by an angled cutting edge oriented toward said first end plane, said first and second blades lying in first and second intersecting planes, respectively;

(B) inserting said first blade tip into said matboard with the inserted portion of said trailing edge located on said first end plane;

(C) making said first cut in said matboard by moving said carrier toward said second end plane to a second position where said first blade cutting edge intersects said second end plane at the matboard face;

(D) withdrawing said first blade tip from said matboard;

(E) locating said second blade at a location where said trailing edge is spaced from said second end plane by a selected distance and inserting said second blade into said matboard until said second blade tip intersects said first cut;

(F) making said second cut in said matboard by moving said carrier back to said first position where said second blade cutting edge intersects said matboard face at a location spaced from said first end plane by a selected distance; and (G) withdrawing said second blade tip from said matboard.

5. The method in accordance with claim 4 in which step (A) includes orienting said blades to lie in said first and second intersecting planes, respectively, wherein the planes are separate and define a generally V-shaped configuration diverging from the intersection; and said selected distance in steps (E) and (F) is less than one-half of the groove width wherein said width is measured perpendicular to the length of said first cut.

6. The method in accordance with claim 4 in which steps (B) and (E) include inserting said first blade tip and said second blade tip, respectively, perpendicularly to said predetermined length; and step (A) includes offsetting said first and second blades from each other in said carrier relative to the length of the groove.

7. A method for providing a matboard with two cuts through a face of the matboard from between which a portion of the matboard can be removed to expose a decorative, linear groove having an angular transverse cross-section, said method comprising the steps of:

(A) positioning said matboard adjacent a linear guide;

(B) positioning a carrier for guided movement along said guide while said carrier carries two blades oriented in separate planes which intersect each other and which lie at an oblique angle relative to the matboard face;

(C) inserting one of said blades into said matboard to a selected depth with said carrier at a selected first location along said linear guide and then moving said carrier along said guide in a first of two opposite directions for a predetermined length of travel to make a first cut in said matboard defining a first side of said groove;

(D) retracting said one blade out of said matboard;

(E) with said carrier at a second location along said linear guide, inserting the other of said blades into said matboard to a selected depth at least intersecting said first cut and then moving said carrier in the second of two opposite directions to make a second cut in said matboard defining a second side of said groove; and (F) retracting said other blade out of said matboard.

8. The method in accordance with claim 7 wherein said groove has a length and each blade has a tip defined by a trailing edge and an angled cutting edge, and wherein steps (C) and (E) include inserting said one blade and said other blade, respectively, such that the trailing edge of each blade is perpendicular to the length of the groove.

9. A method for providing a matboard with two cuts through a face of the matboard from between which cuts a portion of the matboard can be removed to expose a decorative, linear groove having an angular transverse cross-section, said method comprising the steps of:

(A) positioning said matboard adjacent a linear guide;

(B) positioning a carrier for guided movement along said guide while said carrier carries two blades which (1) each lies in a separate plane wherein said planes are oriented at an oblique angle relative to the matboard face and intersect each other along a line defining the bottom of the groove, and (2) each has a tip defined by a leading cutting edge and a straight trailing edge oriented so that the tips are offset relative to the length of the groove; and (C) inserting said blades to selected depths in said matboard with the straight trailing edge of each said blade oriented perpendicular to said line defining the bottom of the groove;

said step (B) including orienting said cutting edges of said blades to face in opposite directions;

said step (C) including separately inserting said blades and separately moving said carrier while only one blade at a time is inserted and with said straight trailing edge of said inserted blade oriented generally perpendicularly to said line defining the bottom of the groove, said separate movement of each said inserted blade with said carrier being effected by moving said carrier in two opposite directions seriatim to make said cuts.

* * * * *